US008847831B2

(12) United States Patent
Kato et al.

(10) Patent No.: US 8,847,831 B2
(45) Date of Patent: Sep. 30, 2014

(54) ANTENNA AND ANTENNA MODULE

(75) Inventors: Noboru Kato, Nagaokakyo (JP); Katsumi Taniguchi, Nagaokakyo (JP); Nobuo Ikemoto, Nagaokakyo (JP); Hiromi Murayama, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 349 days.

(21) Appl. No.: 13/334,462

(22) Filed: Dec. 22, 2011

(65) Prior Publication Data

US 2012/0092222 A1 Apr. 19, 2012

Related U.S. Application Data

(63) Continuation of application No. PCT/JP2010/053496, filed on Mar. 4, 2010.

(30) Foreign Application Priority Data

Jul. 3, 2009 (JP) ..... 2009-158334

(51) Int. Cl.
*H01Q 11/12* (2006.01)

(52) U.S. Cl.
USPC ..... 343/742

(58) Field of Classification Search
CPC ..... H01Q 7/00; H01Q 7/04; H01Q 11/12; G08B 13/2474; G06K 7/10336
USPC ..... 343/741–745, 895, 866–868; 235/492
See application file for complete search history.

(56) References Cited

U.S. PATENT DOCUMENTS 3,364,564 A 1/1968 Kurtz et al.
4,794,397 A 12/1988 Ohe et al.

(Continued)

FOREIGN PATENT DOCUMENTS

CA 2 279 176 A1 7/1998
CN 101351924 A 1/2009

(Continued)

OTHER PUBLICATIONS

Official Communication issued in International Patent Application No. PCT/JP2008/063025, mailed on Aug. 12, 2008.

(Continued)

*Primary Examiner* — Huedung Mancuso
(74) *Attorney, Agent, or Firm* — Keating & Bennett, LLP

(57) ABSTRACT

An antenna includes a flexible sheet that includes a first main surface including a first coil electrode located thereon and a second main surface including a second coil electrode located thereon. The first and second coil electrodes are wound in opposite directions when viewed from different directions. A first end of the first coil electrode faces a first end of the second coil electrode through the flexible sheet. Similarly, a second end of the first coil electrode faces a second end of the second coil electrode through the flexible sheet. The first and second coil electrodes define an inductor, the first ends of the first and second coil electrodes define a capacitor, and the second ends of the first and second coil electrodes define a capacitor whereby a resonant antenna is provided.

15 Claims, 16 Drawing Sheets

(56) References Cited

U.S. PATENT DOCUMENTS

| | | | | |
|---|---|---|---|---|
| 5,232,765 | A | 8/1993 | Yano et al. | |
| 5,253,969 | A | 10/1993 | Richert | |
| 5,337,063 | A * | 8/1994 | Takahira | 343/741 |
| 5,374,937 | A | 12/1994 | Tsunekawa et al. | |
| 5,399,060 | A | 3/1995 | Richert | |
| 5,491,483 | A | 2/1996 | D'Hont | |
| 5,528,222 | A | 6/1996 | Moskowitz et al. | |
| 5,757,074 | A | 5/1998 | Matloubian et al. | |
| 5,903,239 | A | 5/1999 | Takahashi et al. | |
| 5,936,150 | A | 8/1999 | Kobrin et al. | |
| 5,955,723 | A | 9/1999 | Reiner | |
| 5,995,006 | A | 11/1999 | Walsh | |
| 6,104,311 | A | 8/2000 | Lastinger | |
| 6,107,920 | A | 8/2000 | Eberhardt et al. | |
| 6,172,608 | B1 | 1/2001 | Cole | |
| 6,181,287 | B1 | 1/2001 | Beigel | |
| 6,190,942 | B1 | 2/2001 | Wilm et al. | |
| 6,259,369 | B1 | 7/2001 | Monico | |
| 6,271,803 | B1 | 8/2001 | Watanabe et al. | |
| 6,335,686 | B1 | 1/2002 | Goff et al. | |
| 6,362,784 | B1 | 3/2002 | Kane et al. | |
| 6,367,143 | B1 | 4/2002 | Sugimura | |
| 6,378,774 | B1 | 4/2002 | Emori et al. | |
| 6,406,990 | B1 | 6/2002 | Kawai | |
| 6,448,874 | B1 | 9/2002 | Shiino et al. | |
| 6,452,563 | B1 | 9/2002 | Porte | |
| 6,462,716 | B1 | 10/2002 | Kushihi | |
| 6,542,050 | B1 | 4/2003 | Arai et al. | |
| 6,600,459 | B2 | 7/2003 | Yokoshima et al. | |
| 6,634,564 | B2 | 10/2003 | Kuramochi | |
| 6,664,645 | B2 | 12/2003 | Kawai | |
| 6,763,254 | B2 | 7/2004 | Nishikawa | |
| 6,828,881 | B2 | 12/2004 | Mizutani et al. | |
| 6,837,438 | B1 | 1/2005 | Takasugi et al. | |
| 6,861,731 | B2 | 3/2005 | Buijsman et al. | |
| 6,927,738 | B2 | 8/2005 | Senba et al. | |
| 6,963,729 | B2 | 11/2005 | Uozumi | |
| 7,088,307 | B2 | 8/2006 | Imaizumi | |
| 7,112,952 | B2 | 9/2006 | Arai et al. | |
| 7,119,693 | B1 | 10/2006 | Devilbiss | |
| 7,129,834 | B2 | 10/2006 | Naruse et al. | |
| 7,248,221 | B2 | 7/2007 | Kai et al. | |
| 7,250,910 | B2 | 7/2007 | Yoshikawa et al. | |
| 7,276,929 | B2 | 10/2007 | Arai et al. | |
| 7,317,396 | B2 | 1/2008 | Ujino | |
| 7,405,664 | B2 | 7/2008 | Sakama et al. | |
| 7,436,309 | B2 * | 10/2008 | Koele | 340/572.7 |
| 2002/0011967 | A1 | 1/2002 | Goff et al. | |
| 2002/0044092 | A1 | 4/2002 | Kushihi | |
| 2002/0067316 | A1 | 6/2002 | Yokoshima et al. | |
| 2002/0093457 | A1 | 7/2002 | Hamada et al. | |
| 2003/0020661 | A1 | 1/2003 | Sato | |
| 2003/0045324 | A1 | 3/2003 | Nagumo et al. | |
| 2004/0001027 | A1 | 1/2004 | Killen et al. | |
| 2004/0066617 | A1 | 4/2004 | Hirabayashi et al. | |
| 2004/0217915 | A1 | 11/2004 | Imaizumi | |
| 2004/0219956 | A1 | 11/2004 | Iwai et al. | |
| 2004/0227673 | A1 | 11/2004 | Iwai et al. | |
| 2004/0252064 | A1 | 12/2004 | Yuanzhu | |
| 2005/0092836 | A1 | 5/2005 | Kudo | |
| 2005/0099337 | A1 | 5/2005 | Takei et al. | |
| 2005/0125093 | A1 | 6/2005 | Kikuchi et al. | |
| 2005/0140512 | A1 | 6/2005 | Sakama et al. | |
| 2005/0232412 | A1 | 10/2005 | Ichihara et al. | |
| 2005/0236623 | A1 | 10/2005 | Takechi et al. | |
| 2005/0275539 | A1 | 12/2005 | Sakama et al. | |
| 2006/0001138 | A1 | 1/2006 | Sakama et al. | |
| 2006/0032926 | A1 | 2/2006 | Baba et al. | |
| 2006/0055601 | A1 | 3/2006 | Kameda et al. | |
| 2006/0071084 | A1 | 4/2006 | Detig et al. | |
| 2006/0109185 | A1 | 5/2006 | Iwai et al. | |
| 2006/0145872 | A1 | 7/2006 | Tanaka et al. | |
| 2006/0158380 | A1 | 7/2006 | Son et al. | |
| 2006/0170606 | A1 | 8/2006 | Yamagajo et al. | |
| 2006/0267138 | A1 | 11/2006 | Kobayashi | |
| 2007/0004028 | A1 | 1/2007 | Lair et al. | |
| 2007/0018893 | A1 | 1/2007 | Kai et al. | |
| 2007/0040028 | A1 | 2/2007 | Kawamata | |
| 2007/0052613 | A1 | 3/2007 | Gallschuetz et al. | |
| 2007/0057854 | A1 | 3/2007 | Oodachi et al. | |
| 2007/0164414 | A1 | 7/2007 | Dokai et al. | |
| 2007/0200782 | A1 | 8/2007 | Hayama et al. | |
| 2007/0229276 | A1 | 10/2007 | Yamagajo et al. | |
| 2007/0247387 | A1 | 10/2007 | Kubo et al. | |
| 2007/0252700 | A1 | 11/2007 | Ishihara et al. | |
| 2007/0285335 | A1 | 12/2007 | Bungo et al. | |
| 2007/0290928 | A1 | 12/2007 | Chang et al. | |
| 2008/0024156 | A1 | 1/2008 | Arai et al. | |
| 2008/0070003 | A1 | 3/2008 | Nakatani et al. | |
| 2008/0087990 | A1 | 4/2008 | Kato et al. | |
| 2008/0143630 | A1 | 6/2008 | Kato et al. | |
| 2008/0169905 | A1 | 7/2008 | Slatter | |
| 2008/0272885 | A1 | 11/2008 | Atherton | |
| 2009/0002130 | A1 | 1/2009 | Kato | |
| 2009/0021352 | A1 | 1/2009 | Kataya et al. | |
| 2009/0021446 | A1 | 1/2009 | Kataya et al. | |
| 2009/0065594 | A1 * | 3/2009 | Kato et al. | 235/492 |
| 2009/0109102 | A1 | 4/2009 | Dokai et al. | |
| 2009/0160719 | A1 | 6/2009 | Kato et al. | |
| 2009/0201116 | A1 * | 8/2009 | Orihara | 336/200 |
| 2009/0224061 | A1 | 9/2009 | Kato et al. | |
| 2009/0231106 | A1 | 9/2009 | Okamura | |
| 2009/0262041 | A1 * | 10/2009 | Ikemoto et al. | 343/860 |
| 2009/0266900 | A1 | 10/2009 | Ikemoto et al. | |
| 2009/0278687 | A1 | 11/2009 | Kato | |
| 2009/0321527 | A1 | 12/2009 | Kato et al. | |
| 2010/0103058 | A1 | 4/2010 | Kato et al. | |
| 2010/0156750 | A1 | 6/2010 | Ishibashi et al. | |
| 2011/0031320 | A1 | 2/2011 | Kato et al. | |
| 2011/0063184 | A1 | 3/2011 | Furumura et al. | |

FOREIGN PATENT DOCUMENTS

| | | | |
|---|---|---|---|
| CN | 101385196 | A | 3/2009 |
| CN | 101416353 | A | 4/2009 |
| EP | 0 694 874 | A2 | 1/1996 |
| EP | 0 848 448 | A2 | 6/1998 |
| EP | 0 948 083 | A2 | 10/1999 |
| EP | 0 977 145 | A2 | 2/2000 |
| EP | 1 085 480 | A1 | 3/2001 |
| EP | 1 193 793 | A2 | 4/2002 |
| EP | 1 227 540 | A1 | 7/2002 |
| EP | 1 280 350 | A1 | 1/2003 |
| EP | 1 547 753 | A1 | 6/2005 |
| EP | 1 548 872 | A1 | 6/2005 |
| EP | 1 703 589 | A1 | 9/2006 |
| EP | 1 744 398 | A1 | 1/2007 |
| EP | 1 841 005 | A1 | 10/2007 |
| EP | 1 865 574 | A1 | 12/2007 |
| EP | 1 976 056 | A1 | 10/2008 |
| EP | 1 988 491 | A1 | 11/2008 |
| EP | 1 988 601 | A1 | 11/2008 |
| EP | 1 993 170 | A1 | 11/2008 |
| EP | 2 009 738 | A1 | 12/2008 |
| EP | 2 012 258 | A1 | 1/2009 |
| EP | 2 096 709 | A1 | 9/2009 |
| EP | 2 148 449 | A1 | 1/2010 |
| EP | 2 251 934 | A1 | 11/2010 |
| GB | 2 305 075 | A | 3/1997 |
| GB | 2461443 | A | 1/2010 |
| JP | 50-143451 | A | 11/1975 |
| JP | 61-284102 | A | 12/1986 |
| JP | 62-127140 | U | 8/1987 |
| JP | 02-256208 | A | 10/1990 |
| JP | 03-503467 | A | 8/1991 |
| JP | 03-262313 | A | 11/1991 |
| JP | 04-150011 | A | 5/1992 |
| JP | 04-096814 | U | 8/1992 |
| JP | 04-101168 | U | 9/1992 |
| JP | 04-134807 | U | 12/1992 |
| JP | 05-327331 | A | 12/1993 |
| JP | 6-53733 | A | 2/1994 |
| JP | 06-077729 | A | 3/1994 |
| JP | 06-177635 | A | 6/1994 |

(56) References Cited

FOREIGN PATENT DOCUMENTS

| | | | |
|---|---|---|---|
| JP | 6-260949 | A | 9/1994 |
| JP | 07-183836 | A | 7/1995 |
| JP | 08-055725 | A | 2/1996 |
| JP | 08-056113 | A | 2/1996 |
| JP | 8-87580 | A | 4/1996 |
| JP | 08-88586 | A | 4/1996 |
| JP | 11-149537 | A | 6/1996 |
| JP | 08-176421 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-093029 | A | 4/1997 |
| JP | 9-93029 | A | 4/1997 |
| JP | 09-245381 | A | 9/1997 |
| JP | 09-252217 | A | 9/1997 |
| JP | 09-270623 | A | 10/1997 |
| JP | 09-284038 | A | 10/1997 |
| JP | 9-512367 | A | 12/1997 |
| JP | 10-69533 | A | 3/1998 |
| JP | 10-069533 | A | 3/1998 |
| JP | 10-505466 | A | 5/1998 |
| JP | 10-171954 | A | 6/1998 |
| JP | 10-173427 | A | 6/1998 |
| JP | 10-193851 | A | 7/1998 |
| JP | 10-293828 | A | 11/1998 |
| JP | 10-334203 | A | 12/1998 |
| JP | 11-025244 | A | 1/1999 |
| JP | 11-039441 | A | 2/1999 |
| JP | 11-085937 | A | 3/1999 |
| JP | 11-88241 | A | 3/1999 |
| JP | 11-149538 | A | 6/1999 |
| JP | 11-219420 | A | 8/1999 |
| JP | 11-220319 | A | 8/1999 |
| JP | 11-282993 | A | 10/1999 |
| JP | 11-328352 | A | 11/1999 |
| JP | 11-331014 | A | 11/1999 |
| JP | 11-346114 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2005-229474 | A | 1/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-510271 | A | 8/2000 |
| JP | 2000-242754 | A | 9/2000 |
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 3075400 | U | 11/2000 |
| JP | 2001-10264 | A | 1/2001 |
| JP | 2001-028036 | A | 1/2001 |
| JP | 2007-18067 | A | 1/2001 |
| JP | 2001-043340 | A | 2/2001 |
| JP | 2001-66990 | A | 3/2001 |
| JP | 2001-76111 | A | 3/2001 |
| JP | 2001-084463 | A | 3/2001 |
| JP | 2001-101369 | A | 4/2001 |
| JP | 2001-505682 | A | 4/2001 |
| JP | 2001-168628 | A | 6/2001 |
| JP | 2001-240046 | A | 9/2001 |
| JP | 2001-256457 | A | 9/2001 |
| JP | 2001-257292 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351083 | A | 12/2001 |
| JP | 2001-351084 | A | 12/2001 |
| JP | 2001-352176 | A | 12/2001 |
| JP | 2002-024776 | A | 1/2002 |
| JP | 2002-32731 | A | 1/2002 |
| JP | 2002-042076 | A | 2/2002 |
| JP | 2002-063557 | A | 2/2002 |
| JP | 2002-505645 | A | 2/2002 |
| JP | 2002-76750 | A | 3/2002 |
| JP | 2002-111363 | A | 4/2002 |
| JP | 2002-150245 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |
| JP | 2002-232221 | A | 8/2002 |
| JP | 2002-246828 | A | 8/2002 |
| JP | 2002-252117 | A | 9/2002 |
| JP | 2002-280821 | A | 9/2002 |
| JP | 2002-298109 | A | 10/2002 |
| JP | 2002-319008 | A | 10/2002 |
| JP | 2002-362613 | A | 12/2002 |
| JP | 2002-366917 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-022912 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-288560 | A | 10/2003 |
| JP | 2003-309418 | A | 10/2003 |
| JP | 2003-332820 | A | 11/2003 |
| JP | 2003-536302 | A | 12/2003 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |

(56) References Cited

FOREIGN PATENT DOCUMENTS

| | | | |
|---|---|---|---|
| JP | 2004-126750 | A | 4/2004 |
| JP | 2004-140513 | A | 5/2004 |
| JP | 2004-213582 | A | 7/2004 |
| JP | 2004-519916 | A | 7/2004 |
| JP | 2004-234595 | A | 8/2004 |
| JP | 2004-253858 | A | 9/2004 |
| JP | 2004-282403 | A | 10/2004 |
| JP | 2004-287767 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-033461 | A | 2/2005 |
| JP | 2005-124061 | A | 5/2005 |
| JP | 2005-128592 | A | 5/2005 |
| JP | 2005-135132 | A | 5/2005 |
| JP | 2005-136528 | A | 5/2005 |
| JP | 2005-165839 | A | 6/2005 |
| JP | 2005-167327 | A | 6/2005 |
| JP | 2005-190417 | A | 7/2005 |
| JP | 2005-191705 | A | 7/2005 |
| JP | 2005-192124 | A | 7/2005 |
| JP | 2005-210676 | A | 8/2005 |
| JP | 2005-210680 | A | 8/2005 |
| JP | 2005-217822 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-295135 | A | 10/2005 |
| JP | 2005-311205 | A | 11/2005 |
| JP | 2005-321305 | A | 11/2005 |
| JP | 2005-322119 | A | 11/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-013976 | A | 1/2006 |
| JP | 2006-13976 | A | 1/2006 |
| JP | 2006-031766 | A | 2/2006 |
| JP | 2006-033312 | A | 2/2006 |
| JP | 2006-39902 | A | 2/2006 |
| JP | 2006-039947 | A | 2/2006 |
| JP | 2006-42059 | A | 2/2006 |
| JP | 2006-42097 | A | 2/2006 |
| JP | 2006-053833 | A | 2/2006 |
| JP | 2006-67479 | A | 3/2006 |
| JP | 2006-72706 | A | 3/2006 |
| JP | 2006-074348 | A | 3/2006 |
| JP | 2006-80367 | A | 3/2006 |
| JP | 2006-92630 | A | 4/2006 |
| JP | 2006-102953 | A | 4/2006 |
| JP | 2006-148462 | A | 6/2006 |
| JP | 2006-148518 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-270212 | A | 10/2006 |
| JP | 2006-270681 | A | 10/2006 |
| JP | 2006-287659 | A | 10/2006 |
| JP | 2006-295879 | A | 10/2006 |
| JP | 2006-302219 | A | 11/2006 |
| JP | 2006-309401 | A | 11/2006 |
| JP | 2006-339964 | A | 12/2006 |
| JP | 2007-13120 | A | 1/2007 |
| JP | 2007-28002 | A | 2/2007 |
| JP | 2007-043535 | A | 2/2007 |
| JP | 2007-65822 | A | 3/2007 |
| JP | 2007-79687 | A | 3/2007 |
| JP | 2007-81712 | A | 3/2007 |
| JP | 2007-102348 | A | 4/2007 |
| JP | 2007-116347 | A | 5/2007 |
| JP | 2007-122542 | A | 5/2007 |
| JP | 2007-150642 | A | 6/2007 |
| JP | 2007-150868 | A | 6/2007 |
| JP | 2007-159083 | A | 6/2007 |
| JP | 2007-166133 | A | 6/2007 |
| JP | 2007-172369 | A | 7/2007 |
| JP | 2007-172527 | A | 7/2007 |
| JP | 2007-228325 | A | 9/2007 |
| JP | 2007-266999 | A | 10/2007 |
| JP | 2007-272264 | A | 10/2007 |
| JP | 2007-287128 | A | 11/2007 |
| JP | 2007-295557 | A | 11/2007 |
| JP | 2007-312350 | A | 11/2007 |
| JP | 2007-324865 | A | 12/2007 |
| JP | 2008-033716 | A | 2/2008 |
| JP | 2008-72243 | A | 3/2008 |
| JP | 2008-083867 | A | 4/2008 |
| JP | 2008-097426 | A | 4/2008 |
| JP | 2008-103691 | A | 5/2008 |
| JP | 2008-107947 | A | 5/2008 |
| JP | 2008-148345 | A | 6/2008 |
| JP | 2008-519347 | A | 6/2008 |
| JP | 2008-160874 | A | 7/2008 |
| JP | 2008-197714 | A | 8/2008 |
| JP | 2008-217406 | A | 9/2008 |
| JP | 2008-288915 | A | 11/2008 |
| JP | 11-175678 | A | 1/2009 |
| JP | 2009-017284 | A | 1/2009 |
| JP | 2009-25870 | A | 2/2009 |
| JP | 2009-27291 | A | 2/2009 |
| JP | 2009-044715 | A | 2/2009 |
| JP | 3148168 | U | 2/2009 |
| JP | 2009-182630 | A | 8/2009 |
| JP | 2010-009196 | A | 1/2010 |
| JP | 4609604 | B2 | 1/2011 |
| NL | 9100176 | A | 3/1992 |
| NL | 9100347 | A | 3/1992 |
| WO | 98/33142 | A1 | 7/1998 |
| WO | 99/67754 | A1 | 12/1999 |
| WO | 00/10122 | A2 | 2/2000 |
| WO | 01/95242 | A2 | 12/2001 |
| WO | 02/48980 | A1 | 6/2002 |
| WO | 03/079305 | A1 | 9/2003 |
| WO | 2004/036772 | A1 | 4/2004 |
| WO | 2004/070879 | A | 8/2004 |
| WO | 2004/072892 | A1 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/114821 | A1 | 11/2006 |
| WO | 2007/083574 | A1 | 7/2007 |
| WO | 2007/083575 | A1 | 7/2007 |
| WO | 2007/086130 | A1 | 8/2007 |
| WO | 2007/094494 | A1 | 8/2007 |
| WO | 2007/097385 | A1 | 8/2007 |
| WO | 2007/102360 | A1 | 9/2007 |
| WO | 2007/105348 | A1 | 9/2007 |
| WO | 2007/119310 | A1 | 10/2007 |
| WO | 2007/125683 | A1 | 11/2007 |
| WO | 2008/007606 | A | 1/2008 |
| WO | 2008/081699 | A1 | 7/2008 |
| WO | 2008/126458 | A1 | 10/2008 |
| WO | 2008/133018 | A1 | 11/2008 |
| WO | 2008/140037 | A1 | 11/2008 |
| WO | 2008/142957 | A1 | 11/2008 |
| WO | 2009/011144 | A1 | 1/2009 |
| WO | 2009/011376 | A1 | 1/2009 |
| WO | 2009/011400 | A1 | 1/2009 |

(56) References Cited

FOREIGN PATENT DOCUMENTS

| | | | |
|---|---|---|---|
| WO | 2009/011423 | A1 | 1/2009 |
| WO | 2009/081719 | A1 | 7/2009 |
| WO | 2009/110381 | A1 | 9/2009 |

OTHER PUBLICATIONS

Kato et al.: "Wireless IC Device," U.S. Appl. No. 12/603,608, filed Oct. 22, 2009.
Kato et al.: "Wireless IC Device," U.S. Appl. No. 12/688,072, filed Jan. 15, 2010.
Official Communication issued in International Patent Application No. PCT/JP2009/053693, mailed on Jun. 9, 2009.
Kato: "Composite Antenna," U.S. Appl. No. 12/845,846, filed Jul. 29, 2010.
Official Communication issued in International Patent Application No. PCT/JP2009/053690, mailed on Jun. 2, 2009.
Kato et al.: "Radio Frequency IC Device and Radio Communication System," U.S. Appl. No. 12/859,340, filed Aug. 19, 2010.
Official Communication issued in International Patent Application No. PCT/JP2009/055758, mailed on Jun. 23, 2009.
Kato et al.: "Wireless IC Device," U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device," U.S. Appl. No. 12/861,945, filed Aug. 24, 2010.
Kato: "Wireless IC Device and Electromagnetic Coupling Module," U.S. Appl. No. 12/890,895, filed Sep. 27, 2010.
Official Communication issued in International Patent Application No. PCT/JP2009/059410, mailed on Aug. 4, 2009.
Kato et al.: "Wireless IC Device" U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.
Official Communication issued in International Patent Application No. PCT/JP2009/056698, mailed on Jul. 7, 2009.
Official Communication issued in International Patent Application No. PCT/JP2009/056934, mailed on Jun. 30, 2009.
Kato et al.: "Wireless IC Device"; U.S. Appl. No. 12/903,242, filed Oct. 13, 2010.
Kato et al.: "Wireless IC Device"; U.S. Appl. No. 12/940,103, filed Nov. 5, 2010.
Kato et al.: "Wireless IC Device System and Method of Determining Authenticity of Wireless IC Device"; U.S. Appl. No. 12/940,105, filed Nov. 5, 2010.
Official Communication issued in International Patent Application No. PCT/JP2009/059669, mailed on Aug. 25, 2009.
Official Communication issued in International Patent Application No. PCT/JP2009/062181, mailed on Oct. 13, 2009.
Official Communication issued in corresponding Japanese Application No. 2010-501323, mailed on Apr. 6, 2010.
Kato et al.: "Component of Wireless IC Device and Wireless IC Device"; U.S. Appl. No. 12/944,099, filed Nov. 11, 2010.
Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454, filed Dec. 3, 2010.
Ikemoto et al.:"Radio IC Device"; U.S. Appl. No. 12/981,582, filed Dec. 30, 2010.
Official Communication issued in International Patent Application No. PCT/JP2009/062801, mailed on Oct. 27, 2009.
Ikemoto et al.: "Wireless IC Device and Electronic Apparatus"; U.S. Appl. No. 13/022,695, filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Wireless IC Device"; U.S. Appl. No. 13/080,781, filed Apr. 6, 2011.
Official Communication issued in International Patent Application No. PCT/JP2009/066336, mailed on Dec. 22, 2009.
Official Communication issued in corresponding Japanese Patent Application No. 2010-509439, mailed on Jul. 6, 2010.
Official Communication issued in corresponding Japanese Patent Application No. 2011-032311, mailed on Mar. 29, 2011.
Official Communication issued in corresponding Japanese Patent Application No. 2009-525327, drafted on Sep. 22, 2010.
Official Communication issued in corresponding Japanese Patent Application No. 2011-032311, mailed on Aug. 2, 2011.
Official Communication issued in corresponding Japanese Patent Application No. 2011-032312, mailed on Aug. 2, 2011.
Official Communication issued in corresponding Japanese Patent Application No. 2011-032311, mailed on Aug. 23, 2011.
Kato et al.: "Wireless IC Device Component and Wireless IC Device"; U.S. Appl. No. 13/241,823, filed Sep. 23, 2011.
Kato et al.: "Antenna Device and Method of Setting Resonant Frequency of Antenna Device"; U.S. Appl. No. 13/272,365, filed Oct. 13, 2011.
Official Communication issued in International Patent Application No. PCT/JP2010/057668, mailed on Aug. 17, 2010.
Dokai et al.: "Optical Disc"; U.S. Appl. No. 13/295,153, filed Nov. 14, 2011.
Osamura et al.: "Radio Frequency IC Device and Method of Manufacturing the Same"; U.S. Appl. No. 13/308,575, filed Dec. 1, 2011.
Official Communication issued in International Patent Application No. PCT/JP2010/069417, mailed on Dec. 7, 2010.
Kato: "Wireless IC Device and Coupling Method for Power Feeding Circuit and Radiation Plate"; U.S. Appl. No. 13/325,273, filed Dec. 14, 2011.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.
Kato et al.: "Wireless IC Device"; U.S. Appl. No. 12/211,117, filed Sep. 16, 2008.
Kato et al.: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official Communication issued in International Patent Application No. PCT/JP2010/053496, mailed on Jun. 1, 2010.

(56) References Cited

OTHER PUBLICATIONS

Ikemoto: "Wireless IC Tag, Reader-Writer, and Information Processing System"; U.S. Appl. No. 13/329,354, filed Dec. 19, 2011.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete" "(All About Wireless IC Tags"), RFID, pp. 112-126.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; U.S. Appl. No. 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399; mailed on Aug. 25, 2008.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequency IC Devices and Method of Manufacturing Radio Frequency IC Devices Using the Same"; U.S. Appl. No. 12/388,826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official Communication issued in International Patent Application No. PCT/JP2009/069486, mailed on Mar. 2, 2010.
Kato: "Radio IC Device"; U.S. Appl. No. 13/080,775, filed Apr. 6, 2011.
Kato et al.: "Antenna and Wireless IC Device"; U.S. Appl. No. 13/083,626, filed Apr. 11, 2011.
Official Communication issued in International Patent Application No. PCT/JP2009/070617, mailed on Mar. 16, 2010.
Nagai, "Mounting Technique of RFID by Roll-To-Roll Process", Material Stage, Technical Information Institute Co., LTD, vol. 7, No. 9, 2007, pp. 4-12.
Dokai et al.: "Wireless IC Device"; U.S. Appl. No. 13/088,480, filed Apr. 18, 2011.
Kato et al.: "High-Frequency Device and Wireless IC Device"; U.S. Appl. No. 13/094,928, filed Apr. 27, 2011.
Dokai et al.: "Wireless IC Device"; U.S. Appl. No. 13/099,392, filed May 3, 2011.
Kato et al.: "Radio Frequency IC Device"; U.S. Appl. No. 13/163,803, filed Jun. 20, 2011.
Official Communication issued in International Patent Application No. PCT/JP2010/050170, mailed on Apr. 13, 2010.
Official Communication issued in International Patent Application No. PCT/JP2010/051205, mailed on May 11, 2010.
Kato: "Wireless IC Device, Wireless IC Module and Method of Manufacturing Wireless IC Module"; U.S. Appl. No. 13/169,067, filed Jun. 27, 2011.
Kato et al.: "Antenna and Wireless IC Device"; U.S. Appl. No. 13/190,670, filed Jul. 26, 2011.
Shiroki et al.: "RFIC Chip Mounting Structure"; U.S. Appl. No. 13/223,429, filed Sep. 1, 2011.
Official Communication issued in International Patent Application No. PCT/JP2010/056559, mailed on Jul. 27, 2010.
Taniguchi et al.: "Antenna Device and Radio Frequency IC Device"; U.S. Appl. No. 13/232,102, filed Sep. 14, 2011.
Official Communication issued in corresponding Chinese Patent Application No. 201080030228.5, mailed on May 22, 2014.

* cited by examiner

ANTENNA AND ANTENNA MODULE

BACKGROUND OF THE INVENTION

1. Field of the Invention

The present invention relates to an antenna and an antenna module used for communication utilizing electromagnetic coupling such as RFID communication.

2. Description of the Related Art

In recent years, proximity communication systems using various non-contact ICs have been broadly used in various fields. Such a communication system includes a non-contact IC card including a wireless communication IC and a card reader. In this communication system, when the non-contact IC card is moved closer to the card reader within a predetermined distance, communication is performed. To perform the communication, an antenna in which a resonant frequency is set in accordance with a frequency of a communication signal is required. Such an antenna disclosed in Japanese Unexamined Patent Application Publication No. 2001-84463 and Japanese Unexamined Patent Application Publication No. 10-334203 basically has a coil electrode wound in a planar manner and generates a capacitance used to set a resonant frequency together with an inductance of the coil electrode.

In Japanese Unexamined Patent Application Publication No. 2001-84463, for example, the antenna includes coil electrodes wound on front and back surfaces of an insulation sheet in a predetermined manner. These coil electrodes are arranged so as to face each other such that a desired capacitance is generated. Here, the coil electrodes have large widths, and accordingly, a large capacitance is obtained.

Furthermore, in an example of the related art described in Japanese Unexamined Patent Application Publication No. 2001-84463, a coil electrode and one of a pair of counter electrodes of a capacitor are formed on a front surface of an insulation sheet, and the other counter electrode of the capacitor is formed on a back surface. In this configuration, a conductive through hole is mechanically formed in the insulation sheet so that the counter electrode formed on the back surface and a circuit pattern formed on the front surface are connected to each other.

Furthermore, in Japanese Unexamined Patent Application Publication No. 10-334203, a coil electrode is formed on a front surface of an insulation sheet, and an electrostatic capacitance controlling pattern used to generate a capacitance with the coil electrode is formed on a back surface. The capacitance is controlled by controlling a shape (line length) of the electrostatic capacitance controlling pattern.

However, in the configuration disclosed in Japanese Unexamined Patent Application Publication No. 2001-84463 above, since the numbers of windings of the coil electrodes are reduced and the coil electrodes have the large widths, a considerably small inductance is obtained although the large capacitance is obtained. Therefore, a magnetic field which can be radiated from the antenna becomes weak and a communication-available distance becomes small. Accordingly, the configuration is not suitable for data communication which requires a predetermined signal level.

Furthermore, in the configuration disclosed in Japanese Unexamined Patent Application Publication No. 2001-84463, the insulation sheet is mechanically punched through so that the electrode pattern formed on the front surface and the electrode pattern formed on the back surface are brought to a conductive state. Accordingly a fabrication process is complicated.

Moreover, in the configuration disclosed in Japanese Unexamined Patent Application Publication No. 10-334203, the electrostatic capacitance controlling pattern is formed on the back surface in a direction that is the same as a winding direction of the coil electrode formed on the front surface in a plan view, that is, when viewed in a direction along a magnetic field on a surface of the antenna. Accordingly, the electrostatic capacitance controlling pattern formed on the back surface does not contribute to the inductance of the antenna, and the inductance only depends on the pattern of the coil electrode formed on the front surface. Therefore, in order to increase the inductance to strengthen the radiation magnetic field, the number of windings of the coil electrode formed on the front surface should be increased, that is, a large antenna should be configured.

SUMMARY OF THE INVENTION

In view of the various problems described above, preferred embodiments of the present invention provide a simple and small antenna that achieves a predetermined magnetic field intensity. Furthermore, preferred embodiments of the present invention provide an antenna module that includes the antenna and achieves excellent communication characteristics.

A preferred embodiment of the present invention provides an antenna including an insulation base member including first and second main surfaces which face each other, a first coil electrode arranged on the first main surface in a winding manner and including end portions, and a second coil electrode arranged on the second main surface and wound in a direction opposite to a winding direction of the first coil electrode when viewed in a direction from the second main surface to the first main surface and including end portions. An end portion of the first coil electrode and an end portion of the second coil electrode at least partially face each other.

In this configuration, in the first and second coil electrode which are located on the respective main surfaces of the insulation base member and which face each other, the first coil electrode is wound in a direction opposite to a winding direction of the second coil electrode when a formation plane of the first coil electrode is viewed from the front and a formation plane of the second coil electrode is viewed from the front, and the end portion of the first coil electrode faces the end portion of the second coil electrode and the end portion of the first coil electrode is coupled to the end portion of the second coil electrode in an AC manner. With this configuration, a direction of a magnetic field generated by the first coil electrode coincides with a direction of a magnetic field generated by the second coil electrode. Therefore, the magnetic fields are added to each other, and a magnetic field of the antenna (magnetic field having an axis extending in a direction perpendicular or substantially perpendicular to the main surfaces) is strengthened. In other words, the first and second coil electrodes function as a coil which is continuously wound a number of times in a certain direction and which generates a magnetic field. Note that since the coil electrodes are simply formed on the respective main surfaces which face each other on the insulation base member in a formation process, an antenna having a simple configuration is fabricated by a simple process.

In this antenna, at least one of the end portions of the first coil electrode and at least one of the end portions of the second coil electrode may be flat electrodes having electrode widths larger than that of the coil electrode and that of the second coil electrode, respectively.

With this configuration, since the end portions which face with each other are the flat electrodes, a large value of a capacitance can be obtained. Accordingly, a range of a settable capacitance is enlarged, and a resonant frequency of the antenna can be easily set. Furthermore, since a large capacitance can be realized, an antenna that is hardly affected by a change of the capacitance due to an external factor can be fabricated. Moreover, since an area in which the end portions face each other becomes large, coupling between the first and second coil electrodes can be enhanced.

In this antenna, both of the end portions of the first coil electrode and both of the end portions of the second coil electrode may be flat electrodes having electrode widths larger than that of the coil electrode and that of the second coil electrode, respectively. Furthermore, one of the end portions of the first coil electrode may face one of the end portions of the second coil electrode and the other of the end portions of the first coil electrode may face the other of the end portions of the second coil electrode.

With this configuration, large capacitances can be generated at both ends of the first and second coil electrodes. Accordingly, the range of the settable capacitance becomes larger, and the resonant frequency of the antenna can be set more easily. Furthermore, an antenna which is hardly affected by a change of the capacitance due to an external factor can be fabricated. Moreover, since a facing area at both end portions are enlarged, the coupling between the first and second coil electrodes can be enhanced.

In this antenna, one of the end portions of the first coil electrode and one of the end portions of the second coil electrode may preferably have winding shapes, for example. Furthermore, the end portion having the winding shape of the first coil electrode may face the end portion having the winding shape of the second coil electrode.

With this configuration, in addition to the magnetic field generated by the first and second coil electrodes, regions having strong magnetic fields can be provided at the winding end portions of the coil electrodes.

Furthermore, the end portions having the winding shapes may be positioned substantially in centers of regions defined in the first and second coil electrodes.

With this configuration, a strong magnetic field can be generated in a region in which a weak magnetic field is generated by the first and second coil electrodes.

The antenna may include at least one of a flat electrode arranged on the first main surface so as to be adjacent to the first coil electrode and a flat electrode arranged on the second main surface so as to be adjacent to the second coil electrode.

With this configuration, a magnetic flux generated by the first and second coil electrodes circles outward relative to the flat electrodes. Accordingly, a large communication range is attained.

Another preferred embodiment of the present invention provides an antenna module including the antenna described above and a wireless communication IC which is disposed on the insulation base member so as to be electrically connected to the first coil electrode or the second coil electrode.

With this configuration, the antenna module includes the antenna and the wireless communication IC. When the antenna described above is used, a magnetic field generated by the antenna is strengthened, and a level of a communication signal of the antenna module is significantly improved. In addition, an extended range communication distance is attained. That is, communication performance of the antenna module is improved.

In this antenna module, the wireless communication IC may be connected to a center electrode included in a group of electrodes which are included in the first coil electrode or the second coil electrode and which are disposed in parallel or substantially in parallel in a winding manner.

In this configuration, a more specific arrangement of the wireless communication IC is described. Since the maximum current amount is obtained in the center electrode included in a group of electrodes aligned in parallel, that is, in a center portion of a single continuous linear coil electrode, a large amount of current can be supplied to the wireless communication IC by connecting the wireless communication IC to the center electrode.

An additional preferred embodiment of the present invention provides an antenna module including the antenna described above, and an electromagnetic coupling module including a wireless communication IC and a power-supply circuit board used to supply power to the wireless communication IC. The electromagnetic coupling module includes an inductor and is disposed on the insulation base member so that the inductor is electromagnetically coupled with the first coil electrode or the second coil electrode.

With this configuration, the antenna module includes the antenna and the electromagnetic coupling module. When the antenna described above is used, a magnetic field generated by the antenna can be strengthened. Furthermore, power supply to the electromagnetic coupling module coupled to the antenna and a level of a communication signal of the antenna module are significantly improved. Accordingly, the level of a communication signal of the antenna module is improved, and an extended range communication distance is attained. That is, communication performance of the antenna module is significantly improved.

In this antenna module, the electromagnetic coupling module may be disposed on the first coil electrode or the second coil electrode.

In this configuration, an arrangement of the electromagnetic coupling module is described in detail. Since the electromagnetic coupling module is disposed on the electrode, a degree of coupling between antenna and the electromagnetic coupling module is significantly improved when compared with a case where the electromagnetic coupling module is disposed far away from the electrode. Accordingly, the communication performance of the antenna module is significantly improved.

In this antenna module, the electromagnetic coupling module may be disposed on a center electrode included in a group of electrodes which are included in the first coil electrode or the second coil electrode and which are arranged in parallel or substantially in parallel in a winding manner.

Also in this configuration, the arrangement of the electromagnetic coupling module is specified in detail. Making the most of a fact that a center electrode included in a group of electrodes which are aligned in parallel, that is, a center portion of a single continuous linear coil electrode corresponds to the maximum current point, the electromagnetic coupling module is disposed at the maximum current point. Accordingly, a magnetic field supplied to the electromagnetic coupling module is strengthened, and the degree of coupling between the antenna and the electromagnetic coupling module is further improved.

In this antenna module, the electromagnetic coupling module may be disposed such that the electromagnetic coupling module is electromagnetically coupled with only one of the electrodes included in the first coil electrode or the second coil electrode.

With this configuration, since the electromagnetic coupling module is electromagnetically coupled with only one of the electrodes, the antenna module is not affected by a phase shift generated when the electromagnetic coupling module is coupled with a plurality of electrodes. Accordingly, the degree of coupling between the antenna and the electromagnetic coupling module can be further improved.

Yet another preferred embodiment of the present invention provides an antenna module including an antenna according to a preferred embodiment described above and an electromagnetic coupling module including a wireless communication IC and a power-supply circuit board used to supply power to the wireless communication IC. The electromagnetic coupling module includes an inductor and is disposed in a position which substantially corresponds to the end portions having the winding shapes when the first main surface of the insulation base member is viewed in a planar manner.

With this configuration, the strong magnetic field generated at the end portions having the winding shapes is supplied to the electromagnetic coupling module. Accordingly, the degree of coupling between the antenna and the electromagnetic coupling module is significantly improved.

Another preferred embodiment of the present invention provides an antenna module including an antenna according to a preferred embodiment described above, and a base antenna which generates a magnetic field in accordance with communication data supplied to a wireless communication IC. The antenna is disposed separately from the base antenna with a predetermined gap interposed therebetween.

With this configuration, the antenna having the configuration described above is used as a resonant antenna, and the magnetic field radiated from the base antenna is significantly amplified. Accordingly, the level of a communication signal is greatly improved when compared with a case where only the base antenna is used, and a large communication range is attained.

According to various preferred embodiments of the present invention, a small antenna which generates a magnetic field stronger than ever before can be realized with a simple configuration. Furthermore, an antenna module having an excellent communication characteristic can be realized using the antenna.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An antenna according to a first preferred embodiment of the present invention will be described with reference to the accompanying drawings.

Figure 1A:
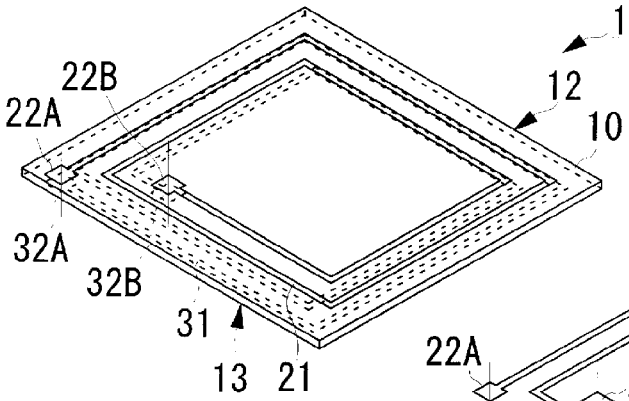
FIGS. 1A-1C include diagrams illustrating a configuration of an antenna 1 according to a first preferred embodiment of the present invention.
Figure 1B:
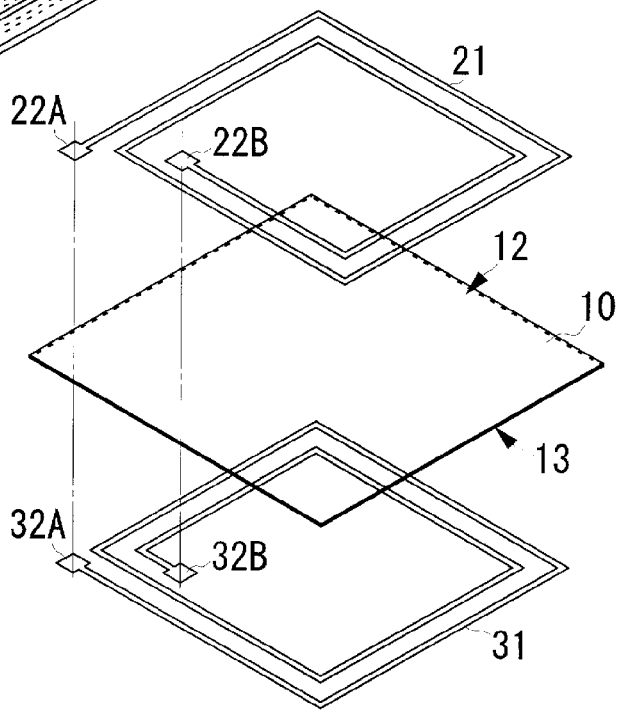
Figure 1C:
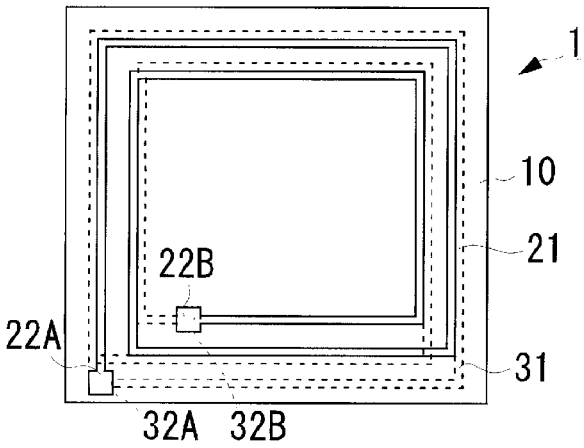
Figure 2:
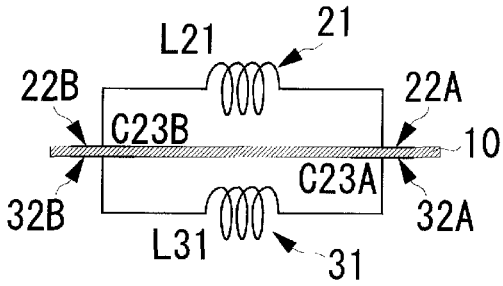
FIG. 2 is a diagram illustrating an equivalent circuit of the antenna 1 shown in FIGS. 1A-1C viewed from a side thereof.

FIGS. 1A-1C include diagrams illustrating a configuration of an antenna 1 according to the first preferred embodiment. Specifically, FIG. 1A is a perspective view, FIG. 1B is an exploded perspective view, and FIG. 1C is a plan view illustrating the antenna 1 viewed from a first main surface 12 side. FIG. 2 is a diagram illustrating an equivalent circuit of the antenna 1 shown in FIGS. 1A-1C viewed from a side thereof.

The antenna 1 includes a flexible sheet 10 which is a flat thin film formed of insulation material such as resin. The flexible sheet 10 includes the first main surface 12 including a first coil electrode 21 located thereon and a second main surface 13 which faces the first main surface 12 and which includes a second coil electrode 31 located thereon. The first and second coil electrodes 21 and 31 preferably are linear electrodes formed of metallic thin films or the like having winding shapes and are attached to the flexible sheet 10 by an adhesive agent or the like, for example.

The first coil electrode 21 includes a first end 22A in an outermost periphery and a second end 22B in an innermost periphery. The first coil electrode 21 is configured such that, when the flexible sheet 10 is viewed from the first main surface 12 side, the linear electrode is successively wound in a clockwise direction starting from the outermost first end 22A toward an inner periphery until the innermost second end 22B is reached. Note that the number of windings of the first coil electrode 21 and a length from a center of the first coil electrode 21 in a plan view to an electrode group are set in accordance with an inductance L21 (refer to FIG. 2) realized by the first coil electrode 21.

The second coil electrode 31 includes a first end 32A in an outermost periphery and a second end 32B in an innermost periphery. The second coil electrode 31 is configured such that, when the flexible sheet 10 is viewed from the second main surface 13 side, the linear electrode is successively wound in a counterclockwise direction starting from the innermost second end 32B toward an outer periphery until the outermost first end 32A is reached. That is, the second coil electrode 31 is wound in a direction opposite to the first coil electrode 21. With this configuration, the first and second coil electrodes 21 and 31 are continuously wound in the same direction when the first and second coil electrodes 21 and 31 are viewed from the same direction, e.g., a direction from the first main surface 12 to the second main surface 13.

Note that the second coil electrode 31 is not required to be formed so as to face the first coil electrode 21 along an entire length thereof as shown in FIG. 1C. Furthermore, the number of windings of the second coil electrode 31 and a length from a center of the second coil electrode 31 in a plan view to an electrode group are set in accordance with an inductance L31 (refer to FIG. 2) realized by the second coil electrode 31.

Each of the first and second ends 22A and 22B of the first coil electrode 21 preferably has a substantially square shape having a predetermined side length different from a width of the liner electrode of the first coil electrode 21. In the example shown in FIG. 1, each of the first and second ends 22A and 22B of the first coil electrode 21 preferably has a substantially square shape having a side length longer than the width of the liner electrode.

Each of the first and second ends 32A and 32B of the second coil electrode 31 preferably has a substantially square shape having a predetermined side length different from a width of the liner electrode of the second coil electrode 31. In the example shown in FIG. 1, each of the first and second ends 32A and 32B of the second coil electrode 31 preferably has a substantially square shape having a side length longer than the width of the liner electrode.

The first end 22A of the first coil electrode 21 and the first end 32A of the second coil electrode 31 are arranged so as to face each other through the flexible sheet 10. Accordingly, the first and second coil electrodes 21 and 31 are coupled to each other in an AC manner, and a capacitance C23A (refer to FIG. 2) is obtained in accordance with an area in which the first ends 22A and 32A face each other and a thickness and an electric permittivity of the flexible sheet 10.

Similarly, the second end 22B of the first coil electrode 21 and the second end 32B of the second coil electrode 31 are arranged so as to face each other through the flexible sheet 10. Accordingly, the first and second coil electrodes 21 and 31 are also coupled to each other there in an AC manner, and a capacitance C23B (refer to FIG. 2) is obtained in accordance with an area in which the second ends 22B and 32B face each other and the thickness and the electric permittivity of the flexible sheet 10.

With this configuration, as shown in FIG. 2, a resonance circuit is defined by connecting a capacitor having the capacitance C23A and a capacitor having the capacitance C23B to both ends of an inductor having the inductance L21 and an inductor having an inductance L31. A resonant frequency of the resonant circuit is set in accordance with a frequency of a communication signal whereby a resonant antenna utilizing electromagnetic coupling is configured.

Furthermore, since the first and second coil electrodes 21 and 31 are wound in directions opposite to each other when viewed from different directions, the first and second coil electrodes 21 and 31 are wound in the same direction when viewed from the same direction. In addition, since the ends are coupled to each other, a current direction of the first main surface 12 coincides with a current direction of the second main surface 13 and a direction of a magnetic field generated by the first coil electrode 21 coincides with a direction of a magnetic field generated by the second coil electrode 31. As a result, the magnetic fields are added to each other and a magnetic field (magnetic field having an axis corresponding to a direction perpendicular or substantially perpendicular to the main surfaces) of the antenna is strengthened. In other words, the first and second coil electrodes 21 and 31 function as a single coil having a larger number of windings in which a direction of the windings is not changed but continuous. Note that since an inductance of a circle coil is proportional to a square of the number of windings of the coil, the larger the number of windings is, the stronger a magnetic field to be generated becomes.

As a result, a considerably large magnetic field is generated when compared with a coil electrode substantially arranged in a circle on a single surface of an insulation sheet, and accordingly, a function of an antenna utilizing electromagnetic coupling can be improved.

Here, even if the flexible sheet 10 is not subjected to a conduction process of mechanically making a through hole, the first and second coil electrodes 21 and 31 are coupled to each other in an AC manner merely by arranging the ends of the first and second coil electrodes 21 and 31 so as to face each other. Accordingly, a resonant antenna having a simple configuration can be fabricated by a simple process.

Since an antenna having a simple configuration can be fabricated by a simple process, the antenna 1 may be configured such that not only thin film electrodes are attached to a flexible sheet but also electrodes are formed using a conductive paste on a surface of paper used as an insulation base material. In this way, a small antenna that can be used with ease and that has excellent heat resistance can be manufactured. Consequently, such an antenna can be used for products fabricated through a high-temperature heat history in which a conventional antenna is cannot be utilized. Furthermore, such an antenna can be easily recycled and reused.

Furthermore, since the antenna 1 is simply configured such that the first and second coil electrodes 21 and 31 are located on the main surfaces of the flexible sheet 10, the antenna 1 is prevented from being larger while the characteristic and the function are maintained. Accordingly, the small and thin antenna 1 can be fabricated.

Moreover, since the area in which the first end 22A faces the first end 32A and the area in which the second end 22B faces the second end 32B are large, coupling between the first and second coil electrodes 21 and 31 is significantly strengthened.

In addition, since the comparatively large capacitances are generated at the both ends of the first and second coil electrodes 21 and 31 as described above, the capacitances are prevented from being varied due to external factors. In the conventional configuration in which coil electrodes are formed on a single side of a flexible sheet, for example, a capacitance is generated between the electrodes arranged in parallel when a finger of a person is simply getting close to the coil electrodes, and accordingly, a resonant frequency is changed. However, since the comparatively large capacitances are generated in this preferred embodiment of the present invention, a change of capacitances caused by a finger of a person does not cause a change of a capacitance of an antenna.

Accordingly, the resonant frequency is prevented from being changed. As a result, the resonant frequency of the antenna can be set as a frequency in the immediate vicinity of a desired frequency of a communication signal, and preferably, a frequency in the immediate vicinity of the desired frequency of the communication signal on a high frequency side. Accordingly, the resonant frequency is not affected by change of a communication environment, and the resonant frequency is maintained so as to be substantially equal to the frequency of the communication signal. Consequently, stable communication is realized.

Furthermore, in the configuration according to this preferred embodiment, the resonant frequency preferably is set mainly using the inductance. With this configuration, even when a distance between the first and second coil electrodes 21 and 31 is large, a resonator is realized. Specifically, a heavy paper sheet may be used as described above. In this case, when a heavy paper sheet having a thickness of about 30 μm or more, for example, is used, the resonant frequency is prevented from being changed and the first and second coil electrodes 21 and 31 are reliably supported. Note that, when a resonant frequency is controlled by capacitances as with the configuration of the related art, electrodes having predetermined areas corresponding to the resonant frequency must be formed on both sides of a thin substrate. However, in this case, it is difficult to form a substrate in which portions thereof have even thicknesses. Therefore, a desired resonant frequency is not realized. On the other hand, when the configuration according to the present preferred embodiment of the present invention is used, such a problem is solved.

Moreover, since the resonant frequency preferably is set mainly using the inductance according to the configuration of the present preferred embodiment of the present invention, the resonant frequency is not considerably affected by the area in which the coil electrodes disposed on the both sides face each other. Accordingly, the first and second coil electrodes 21 and 31 can be arranged so as to face each other along the entire lengths thereof. Consequently, a floating capacitance caused by electrodes which do not face each other can be prevented from being generated, and a change of the resonant frequency is reduced. However, in the configuration in the related art in which a resonant frequency is controlled by capacitances, the area in which the electrodes face each other are important, and in some portions, the coil electrodes do not face each other depending on the desired area in which the electrodes face each other. Therefore, a floating capacitance is generated and the resonant frequency may be changed. On the other hand, with the configuration of the present preferred embodiment, such a problem is solved.

Figure 3A:
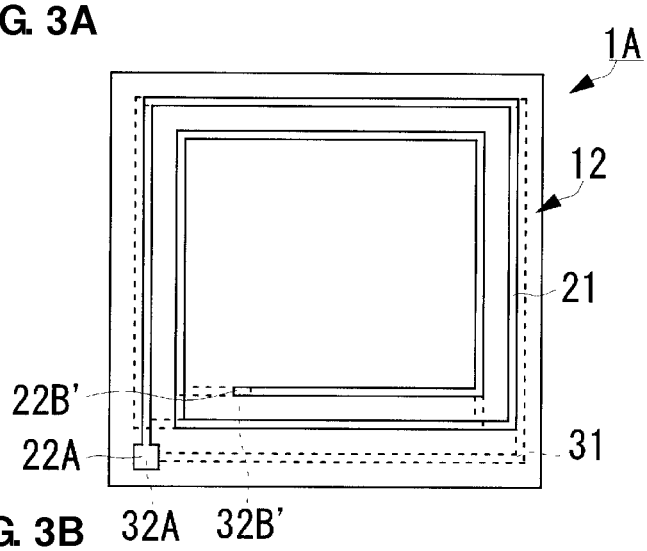
FIGS. 3A-3C include plan views illustrating configurations of other antennas 1A to 1C according to the first preferred embodiment which are viewed from first main surface 12 sides.
Figure 3B:
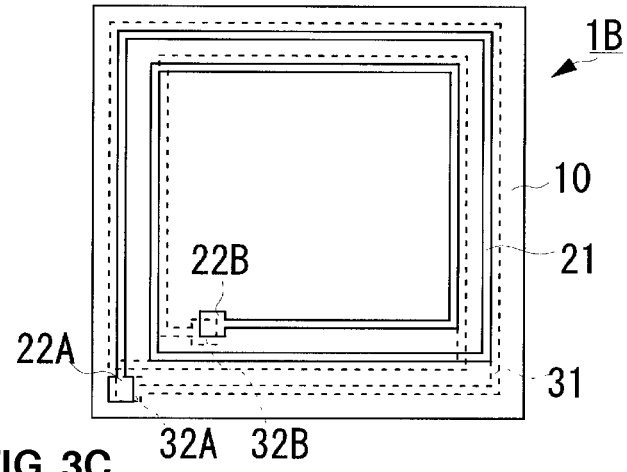
Figure 3C:
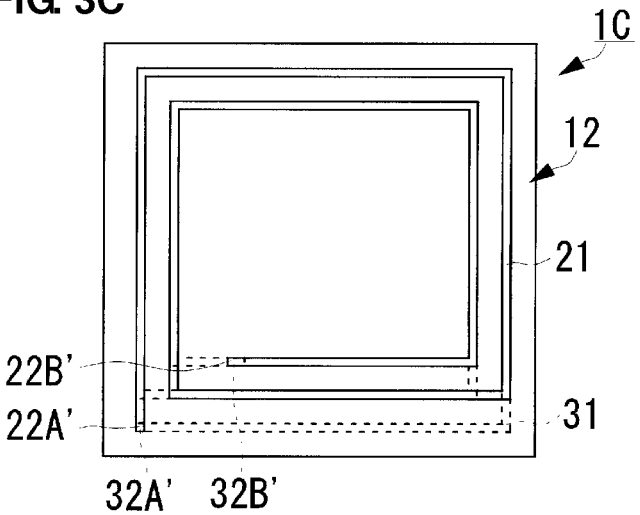

Note that, in the preferred embodiment described above, the first and second coil electrodes 21 and 31 preferably do not face each other along substantially the entire lengths thereof but only the first ends 22A and 32A face each other and the second ends 22B and 32B face each other. However, various configurations as shown in FIGS. 3A-3C may be adopted. FIGS. 3A-3C includes plan views illustrating configurations of other antennas 1A to 1C according to the first preferred embodiment which are viewed from first main surface 12 sides.

In the antenna 1A shown in FIG. 3A, first and second coil electrodes 21 and 31 are partially overlapped with each other when compared with the configuration shown in FIGS. 1A-1C. Furthermore, each of first ends 22A and 32A preferably has a square shape having a side length larger than a width of the corresponding one of the first and second coil electrodes 21 and 31 the first ends 22A and 32A face each other. Although second ends 22B' and 32B' face each other, unlike the first ends 22A and 32A, the second ends 22B' and 32B' do not have a square shape but merely serve as terminal portions of the corresponding first and second coil electrodes 21 and 31.

In the antenna 1B shown in FIG. 3B, first ends 22A and 32A do not face each other in the entire area thereof but the first ends 22A and 32A are partially face each other when compared with the configuration shown in FIG. 1. Similarly, second ends 22B and 32B do not face each other along the entire area thereof but are arranged to partially face each other.

In the antenna 1C shown in FIG. 3C, a region in which first and second coil electrodes 21 and 31 face each other is larger than that in the configuration shown in FIG. 3A, and first ends 22A' and 32A' merely serve as terminal portions of the first and second coil electrodes 21 and 31. Furthermore, when the region in which the first and second coil electrodes 21 and 31 face each other is large as shown in FIG. 3C, the first ends 22A' and 32A' may not face each other or second ends 32B' and 32B' may not face each other.

Even with these configurations, by winding the second coil electrode 31 in a direction opposite to a winding direction of the first coil electrode 21 when the first and second coil electrodes 21 and 31 are viewed from different directions, the first and second coil electrodes 21 and 31 are continuously wound in the same direction when the first and second coil electrodes 21 and 31 are viewed from the same direction. When at least the first ends or the second ends face each other so that a desired resonant frequency can be set, the operation effect described above is attained. Furthermore, when the configurations shown in FIGS. 3A to 3C are adopted, the first and second coil electrodes 21 and 31 face each other along substantially the entire lengths thereof and a capacitance is generated between the first and second coil electrodes 21 and 31 along substantially the entire lengths thereof. Accordingly, a change of the resonant frequency caused by generation of capacitances between electrode portions of each of the first and second coil electrodes 21 and 31 arranged in parallel or substantially in parallel can be suppressed. Note that the configurations shown in FIGS. 3A to 3C are examples which realize the configuration of the present preferred embodiment of the present invention, and the operational effects described above can be realized by a configuration obtained by combining these configurations.

Furthermore, although the first and second ends 22A and 22B of the first coil electrode 21 and the first and second ends 32A and 32B of the second coil electrode 31 preferably have square shapes in the configuration described above as shown in FIGS. 1A-1C, the shapes are not limited to square and appropriate shapes may be used as long as a desired area in which the first and second coil electrodes 21 and 31 face each other (desired capacitance) is obtained.

Next, an antenna according to a second preferred embodiment will be described with reference to the accompanying drawings.

Figure 4A:
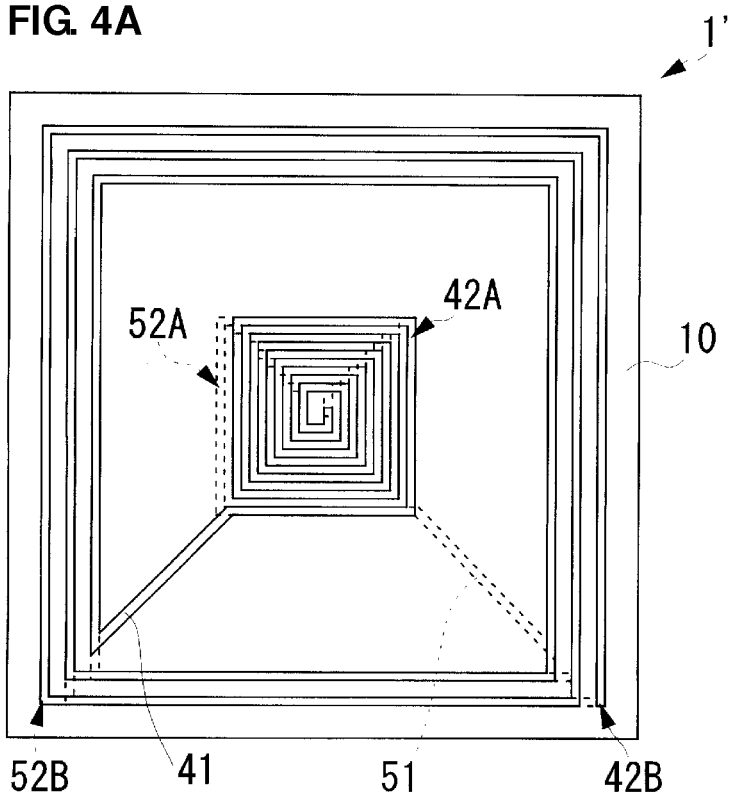
FIGS. 4A and 4B include diagrams illustrating a plan view and an equivalent circuit, respectively, illustrating an antenna 1' according to a second preferred embodiment of the present invention which is viewed from a first main surface 12 side.
Figure 4B:
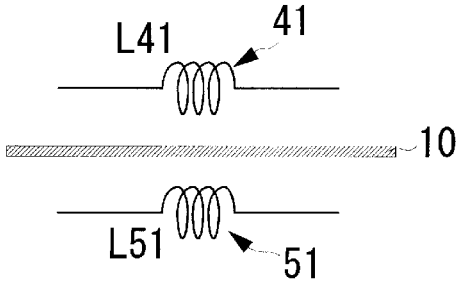
Figure 5A:
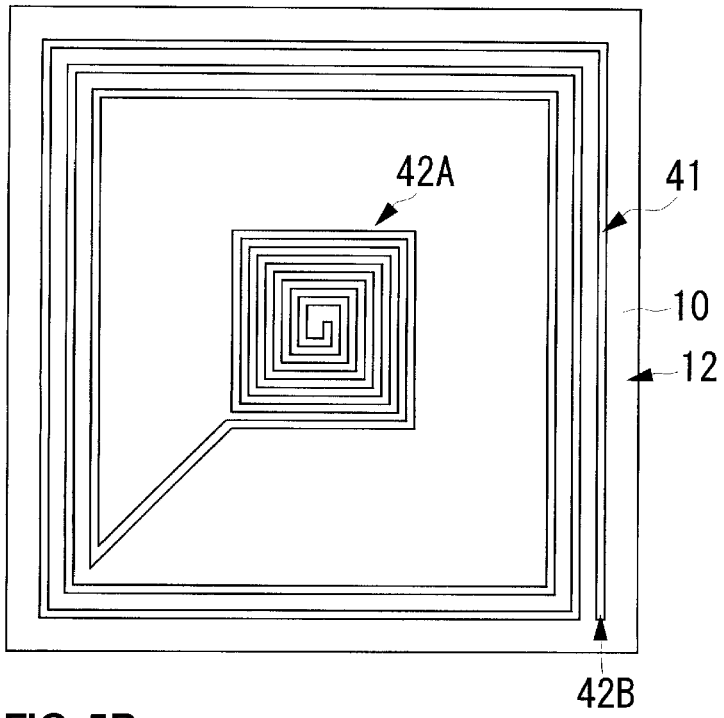
FIGS. 5A and 5B include a plan view illustrating the antenna 1' shown in FIGS. 4A and 4B viewed from the first main surface 12 side and a plan view illustrating a second main surface 13 viewed from the first main surface 12 side.
Figure 5B:
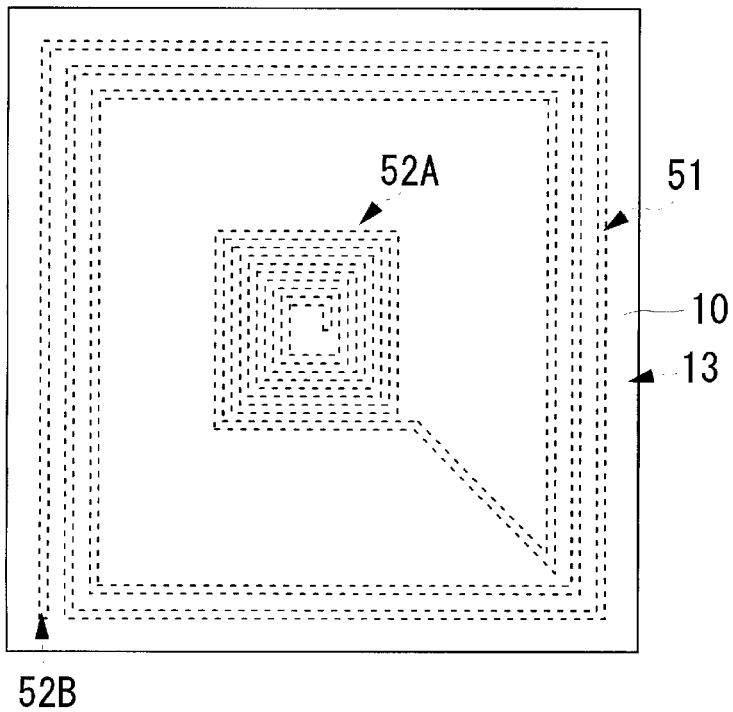

FIG. 4A is a plan view illustrating an antenna 1' according to the second preferred embodiment which is viewed from a first main surface 12 side. FIG. 4B is an equivalent circuit of the antenna 1' shown in FIG. 4A which is viewed from a side thereof. FIG. 5A is a plan view illustrating the first main surface 12 of the antenna 1' shown in FIGS. 4A and 4B, and FIG. 5B is a plan view illustrating a second main surface 13 of the antenna 1' shown in FIGS. 4A and 4B viewed from the first main surface 12 side.

As with the antenna 1 according to the first preferred embodiment, the antenna 1' includes a flexible sheet 10. The flexible sheet 10 includes the first main surface 12 including a third coil electrode 41 disposed thereon and includes the second main surface 13 which faces the first main surface 12 and includes a fourth coil electrode 51 disposed thereon.

Each of the third and fourth coil electrodes 41 and 51 preferably is a linear electrode formed of a metallic thin film or the like which is wound in a spiral manner and is attached to the flexible sheet 10 by an adhesive agent or the like, for example.

The third coil electrode 41 includes a first end 42A which is wound in a spiral manner in an innermost periphery and a second end 42B in an outermost periphery as shown in FIG. 5A. Furthermore, the third coil electrode 41 is configured such that the linear electrode is continuously wound in a clockwise direction starting from the first end 42A in the innermost periphery toward the outer periphery until the second end 42B is reached when the flexible sheet 10 is viewed from the first main surface 12 side. Note that the number of windings of the third coil electrode 41 and a length from a center of the third coil electrode 41 in a plan view to an electrode group is set in accordance with an inductance L41 (refer to FIG. 4B) realized by the third coil electrode 41.

The fourth coil electrode 51 includes a first end 52A in an innermost periphery and a second end 52B in an outermost periphery as shown in FIG. 5B. Furthermore, the fourth coil electrode 51 is configured such that the linear electrode is continuously wound in a counterclockwise direction starting from the second end 52B in the outermost periphery toward the inner periphery until the first end 52A is reached when the flexible sheet 10 is viewed from the second main surface 13 side. That is, the third coil electrode 41 is wound in a direction opposite to the winding direction of the fourth coil electrode 51. With this configuration, the third and fourth coil electrodes 41 and 51 are continuously wound in the same direction when viewed from the same direction, for example, when viewed in a direction from the first main surface 12 to the second main surface 13. Here, the fourth coil electrode 51 faces the third coil electrode 41 along entire lengths thereof as shown in FIG. 4A. With this facing configuration, a capacitance between the third and fourth coil electrodes 41 and 51 can be obtained. Note that the number of windings of the fourth coil electrode 51 and a length from a center of the fourth coil electrode 51 in a plan view to an electrode group is set in accordance with an inductance L51 (refer to FIG. 4B) realized by the fourth coil electrode 51.

The first end 42A of the third coil electrode 41 preferably includes the linear electrode which is wound a predetermined number of times substantially in the center of a formation region of the third coil electrode 41. Similarly, the first end 52A of the fourth coil electrode 51 preferably includes the linear electrode which is wound a predetermined number of times substantially in a center of a formation region of the fourth coil electrode 51. The first end 42A of the third coil electrode 41 faces the first end 52A of the fourth coil electrode 51 along substantially the entire lengths thereof, and a terminal portion of the first end 42A faces a terminal portion of the first end 52A.

With this configuration, the third and fourth coil electrodes 41 and 51 affect each other so that magnetic fields thereof are strengthened, as with the first and second coil electrodes 21 and 31 of the first preferred embodiment. Consequently, a strong magnetic field of the antenna 1' is generated. Furthermore, since the first ends 42A and 52A are wound in a spiral manner, strong magnetic fields are also generated in the formation regions of the first ends 42A and 52A. Moreover, since the first ends 42A and 52A are disposed substantially in the center of the formation regions of the third and fourth coil electrodes 41 and 51, a strong magnetic field is generated in a region in which a weak magnetic field is generated by the third and fourth coil electrodes 41 and 51. Accordingly, an antenna having a more excellent characteristic when compared with antennas in the related arts can be manufactured.

Note that, in the antenna 1' shown in FIGS. 4A-5B, the second ends 42B and 52B do not face each other, and any problem does not particularly arise with this configuration as long as the purpose of the antenna 1' is to supply electric power. Furthermore, it is not particularly necessary to arrange the second ends 42B and 52B to face each other as long as a desired capacitance is obtained by an area in which the third and fourth coil electrodes 41 and 51 face each other and an area in which the first ends 42A and 52A face each other and as long as the antenna 1' is used for data communication and utilizes a resonant frequency. On the other hand, when an area in which the third and fourth coil electrodes 41 and 51 face each other is reduced, as with the first preferred embodiment, the second ends 42B and 52B may face each other by a predetermined area so that a required capacitance is obtained.

Next, an antenna module according to a third preferred embodiment will be described with reference to the accompanying drawings.

Figure 6A:
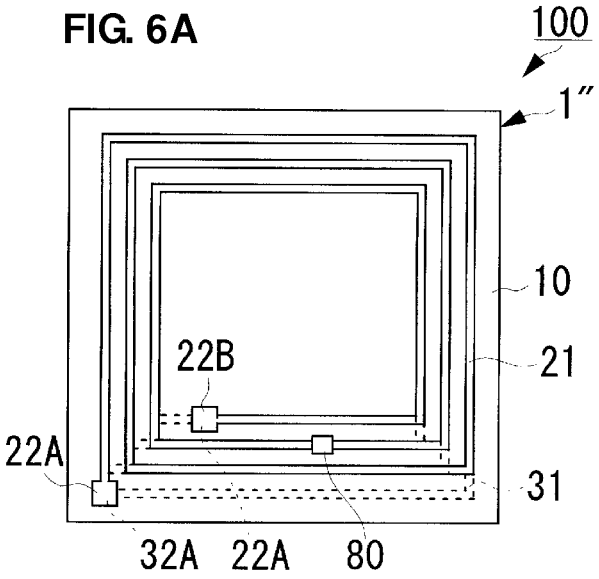
FIGS. 6A-6C include a plan view illustrating a configuration of an antenna module 100 according to a third preferred embodiment of the present invention which is viewed from a first main surface 12 side, a diagram illustrating a connection configuration between an antenna 1" and a wireless communication IC 80, and a diagram illustrating an equivalent circuit of the antenna module 100 viewed from a side thereof.
Figure 6B:
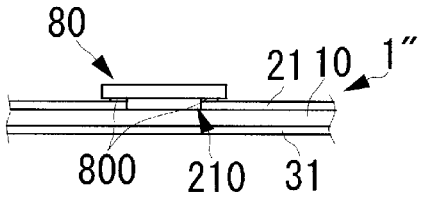
Figure 6C:
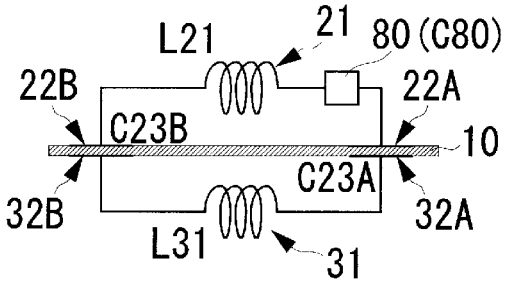

FIG. 6A is a plan view illustrating a configuration of an antenna module 100 according to a third preferred embodiment which is viewed from a first main surface 12 side. FIG. 6B is a diagram illustrating a connection configuration between an antenna 1" and a wireless communication IC 80. FIG. 6C is a diagram illustrating an equivalent circuit of the antenna module 100 shown in FIG. 6A viewed from a side thereof.

The antenna module 100 includes the antenna 1" and the wireless communication IC 80. The number of windings of the antenna 1" is preferably different from that of the antenna 1 of the first preferred embodiment. The antenna 1" is configured such that first and second coil electrodes 21 and 31 face each other along substantially the entire lengths thereof, and other basic configurations are preferably the same as those of the antenna 1 of the first preferred embodiment.

The wireless communication IC 80 is a package element including a semiconductor circuit which performs wireless communication and includes a mounting electrode located on a predetermined surface (for example, a lower surface of the element in FIG. 6B). The first coil electrode 21 of the antenna 1" includes a cutout portion 210, as shown in FIG. 6B at a portion where the wireless communication IC 80 is mounted. The mounting electrode of the wireless communication IC 80 is mounted using a conductive material 800 such as solder on the first coil electrode 21 positioned on both sides of the cutout portion 210. With this structure, the antenna 1" is electrically connected to the wireless communication IC 80, and an inductance L21 of the first coil electrode 21, an inductance L31 of the second coil electrode 31, capacitances C23A and C23B which are generated in both ends of the first and second coil electrodes 21 and 31, and an internal capacitance C80 of the wireless communication IC 80 constitute a resonant circuit. As a result, the wireless communication IC 80 can realize resonant communication utilizing electromagnetic coupling through the antenna 1".

Note that the wireless communication IC 80 is connected to a portion at a center of a group of electrodes of the first coil electrode 21 which are wound in parallel or substantially in parallel, that is, a portion at the center of a single linear electrode defining the first coil electrode 21. With this configuration, the connection portion corresponds to the maximum current point of the first coil electrode 21, and accordingly, communication with the wireless communication IC 80 can be performed with high efficiency.

When the antenna 1" described above is included in the antenna module 100, the small antenna module 100 having an excellent communication characteristic can be fabricated with a simple configuration.

Note that, although the wireless communication IC 80 is preferably directly connected to the first coil electrode 12 in this preferred embodiment, the wireless communication IC 80 may be electrically coupled to the first main surface 12 using an electrostatic induction.

Next, an antenna module according to a fourth preferred embodiment will be described with reference to the accompanying drawings.

Figure 7A:
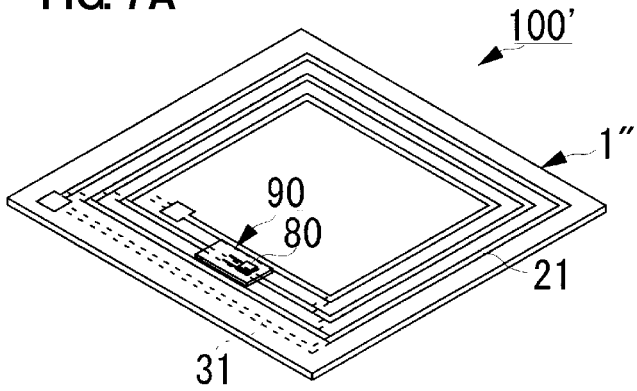
FIGS. 7A-7C include a perspective view of an appearance of an antenna module 100' according to a fourth preferred embodiment of the present invention, a plan view illustrating the antenna module 100' viewed from a first main surface 12 side, and a diagram illustrating an equivalent circuit of the antenna module 100' viewed from a side thereof.
Figure 7B:
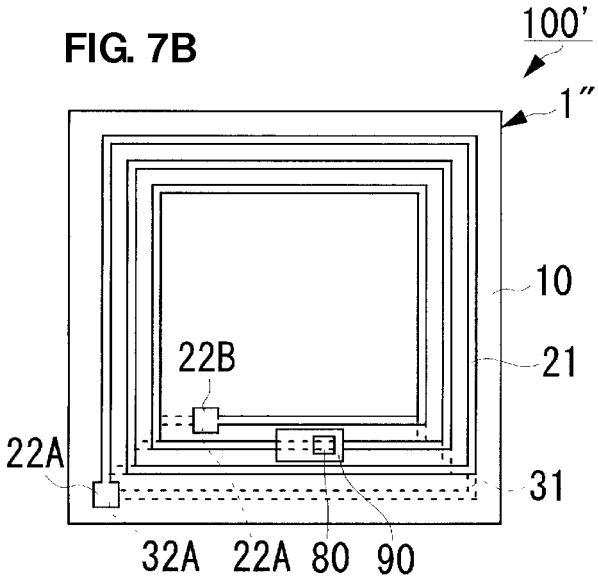
Figure 7C:
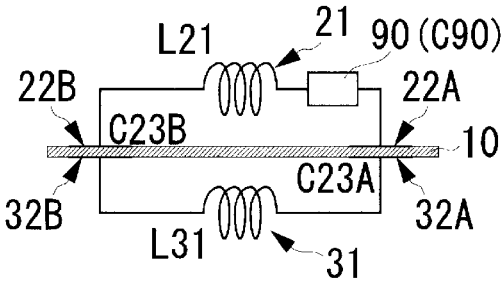

FIG. 7A is a perspective view of an appearance of an antenna module 100' according to the fourth preferred embodiment of the present invention. FIG. 7B is a plan view of the antenna module 100' shown in FIG. 7A viewed from a first main surface 12 side. FIG. 7C is a diagram illustrating an equivalent circuit of the antenna module 100' shown in FIG. 7A viewed from a side thereof.

Figure 8A:
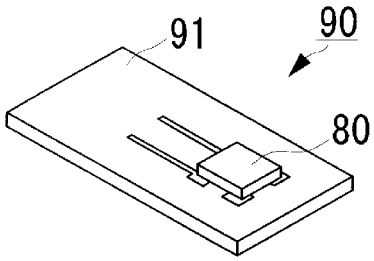
FIGS. 8A and 8B are diagrams illustrating a configuration of an electromagnetic coupling module 90 used in the antenna module 100' shown in FIGS. 7A-7C.
Figure 8B:
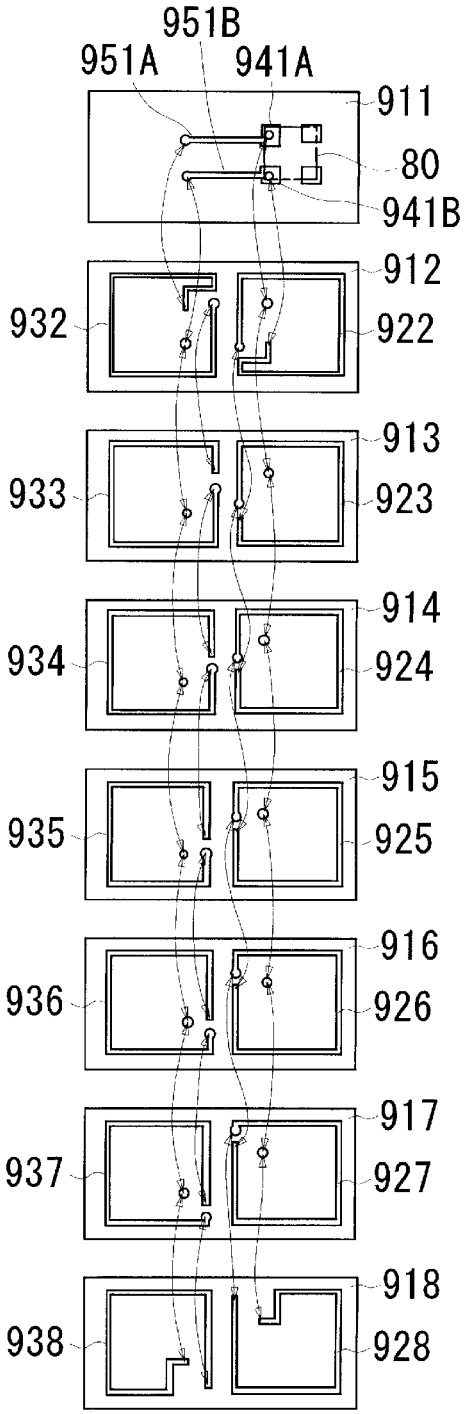

Furthermore, FIGS. 8A and 8B include diagrams illustrating a configuration of an electromagnetic coupling module 90 used in the antenna module 100' wherein FIG. 8A is a perspective view of an appearance and FIG. 8B is an exploded lamination view.

The antenna module 100' includes an antenna 1" and the electromagnetic coupling module 90. The antenna 1" preferably is different from the antenna 1 of the first preferred embodiment in the number of windings and is configured such that first and second coil electrodes 21 and 31 face each other along substantially the entire lengths thereof. Other basic configurations are preferably the same as those of the antenna 1.

The electromagnetic coupling module 90 includes a power supply substrate 91 and a wireless communication IC 80 mounted on the power supply substrate 91 as shown in FIG. 8. The power supply substrate 91 includes a laminated circuit board obtained by laminating dielectric layers including electrode patterns formed thereon. As shown in FIG. 8B, for example, the power supply substrate 91 is preferably configured by laminating eight dielectric layers 911 to 918. On the dielectric layer 911 defining an uppermost layer, mounting lands 941A and 941B for mounting the wireless communication IC 80 are disposed. On the mounting lands 941A and 941B, surface electrode patterns 951A and 951B are provided, respectively. On the dielectric layers 922 to 928 defining second to eighth layers, first C-ring pattern electrodes 922 to 928 are disposed, respectively, and second C-ring pattern electrodes 932 to 938 are disposed, respectively.

The first C-ring pattern electrodes 922 to 928 are electrically connected to one another through via holes and constitute a first coil having an axis extending in a lamination direction. Both ends of the first coil are connected to the mounting lands 941A and 941B disposed on the dielectric layer 911 defining the uppermost layer through the via holes. Furthermore, the second C-ring pattern electrodes 932 to 938 are electrically connected to one another through via holes and constitute a second coil having an axis extending in a lamination direction. Both ends of the second coil are connected to the mounting lands 951A and 951B disposed on the dielectric layer 911 defining the uppermost layer through the via holes.

As described above, the electromagnetic coupling module 90 including the two coils in the power supply substrate 91 is electromagnetically coupled to an external circuit through the two coils, supplies electric power to the wireless communication IC 80, and realizes wireless communication with the external circuit using the wireless communication IC 80.

As shown in FIGS. 7A-7C, the electromagnetic coupling module 90 is disposed on the first coil electrode 21 included in the antenna 1" and fixed by an insulation adhesive agent or the like, for example. Accordingly, the antenna module 100' in which the electromagnetic coupling module 90 and the antenna 1" are electromagnetically coupled to each other can be fabricated.

Here, the antenna 1" and the electromagnetic coupling module 90 are coupled to each other, and an inductance L21 of the first coil electrode 21, an inductance L31 of the second coil electrode 31, capacitances C23A and C23B generated at both ends of the first and second coil electrodes 21 and 31, and an internal capacitance C90 included in the electromagnetic coupling module 90 constitute a resonant circuit as shown in FIG. 7C. Accordingly, the wireless communication IC 80 of the electromagnetic coupling module 90 realizes resonant communication utilizing electromagnetic coupling through the antenna 1".

Since the antenna 1" described above is included in the antenna module 100', the small antenna module 100' attaining excellent communication performance can be fabricated with a simple configuration.

Here, the electromagnetic coupling module 90 is disposed such that a direction in which the first coil electrode 21 positioned beneath the electromagnetic coupling module 90 extends (a direction perpendicular or substantially perpendicular to a width direction) coincides with a longitudinal direction of the electromagnetic coupling module 90, i.e., a direction in which the two coils are aligned. With this arrangement direction, since the electromagnetic coupling can be efficiently performed by the two coils, the antenna module 100' which attains more excellent communication performance can be obtained.

Furthermore, since the electromagnetic coupling module 90 is disposed on the first coil electrode 21 as shown in FIGS. 7A-7C, a degree of coupling between the electromagnetic coupling module 90 and the first coil electrode 21 is enhanced when compared with a case where the electromagnetic coupling module 90 is disposed at a position far from the first coil electrode 21. Accordingly, the antenna module 100' attaining more excellent communication performance can be obtained.

Moreover, as shown in FIGS. 7A-7C, the electromagnetic coupling module 90 is disposed in a portion at a center of a group of electrodes which are wound and which define the first coil electrode 21. This position corresponds to a center of the first coil electrode 21 defining a single continuous line electrode and also corresponds to the maximum current point of the first coil electrode 21. Accordingly, the degree of coupling between the electromagnetic coupling module 90 and the first coil electrode 21 can be further enhanced. In this way, the antenna module 100' attaining more excellent communication performance can be obtained.

In addition, since the electromagnetic coupling module 90 is disposed so as to be coupled with a single electrode included in the group of electrodes which are wound and which define the first coil electrode 21, a loss caused by a phase shift generated when the electromagnetic coupling module 90 is coupled with a plurality of electrodes can be suppressed. Also with this configuration, the antenna module 100' attaining excellent communication performance can be obtained.

Figure 9A:
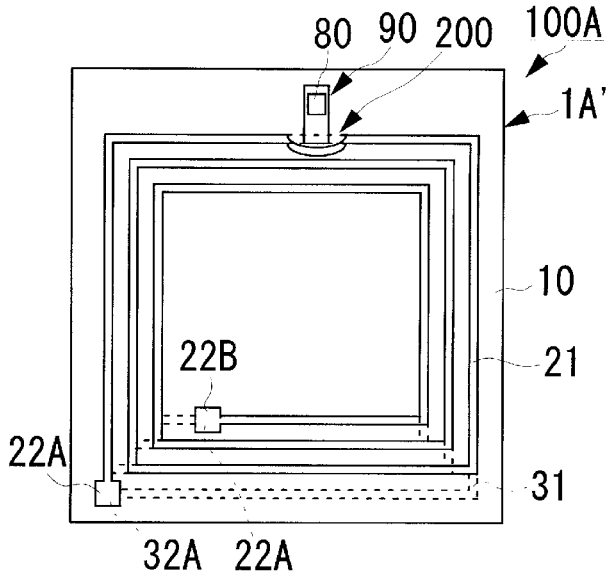
FIGS. 9A and 9B include a plan view illustrating a configuration of another antenna module 100A according to the fourth preferred embodiment viewed from the first main surface 12 side and a diagram illustrating an equivalent circuit of the antenna module 100A viewed from a side thereof.
Figure 9B:
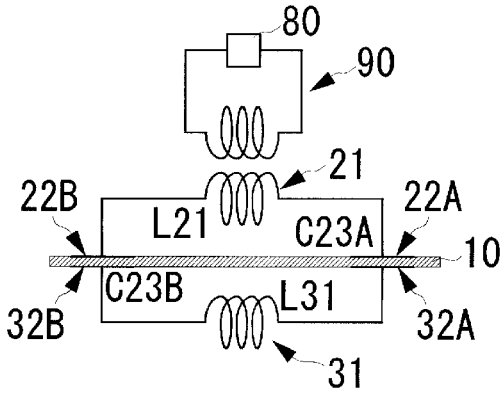

Note that, although an example in which the electromagnetic coupling module 90 is preferably disposed on the first coil electrode 21 is shown as described above, the first coil electrode 21 and the electromagnetic coupling module 90 may be electromagnetically coupled with each other by arranging the electromagnetic coupling module 90 in the vicinity of the first coil electrode 21 as shown in FIGS. 9A and 9B.

FIG. 9A is a plan view illustrating a configuration of another antenna module 100A according to the present preferred embodiment viewed from the first main surface 12 side and FIG. 9B is a diagram illustrating an equivalent circuit of the antenna module 100A shown in FIG. 9A viewed from a side thereof.

As described above, in a case where an electromagnetic coupling module 90 is disposed in the vicinity of the first coil electrode 21, a curve portion 200 is included in a first coil electrode 21 of an antenna 1A' and the electromagnetic coupling module 90 is disposed in a region defined by the curve portion 200. In this case, the electromagnetic coupling module 90 is disposed such that a longitudinal direction of the electromagnetic coupling module 90 is perpendicular or substantially perpendicular to a width direction of the first coil electrode in a position where the electromagnetic coupling module 90 is disposed. By this, the electromagnetic coupling is effectively performed. Also with this configuration, an inductance L21 of the first coil electrode 21, an inductance L31 of a second coil electrode 31, capacitances C23A and C23B generated at both ends of the first and second coil electrodes 21 and 31, and a mutual inductance between an inductor of the electromagnetic coupling module 90 and the first coil electrode 21 constitute a resonant circuit as shown in FIG. 9B. Accordingly, a wireless communication IC 80 of the electromagnetic coupling module 90 realizes resonant communication utilizing electromagnetic coupling through the antenna 1A'.

An antenna module according to a fifth preferred embodiment will now be described with reference to the accompanying drawings.

Figure 10:
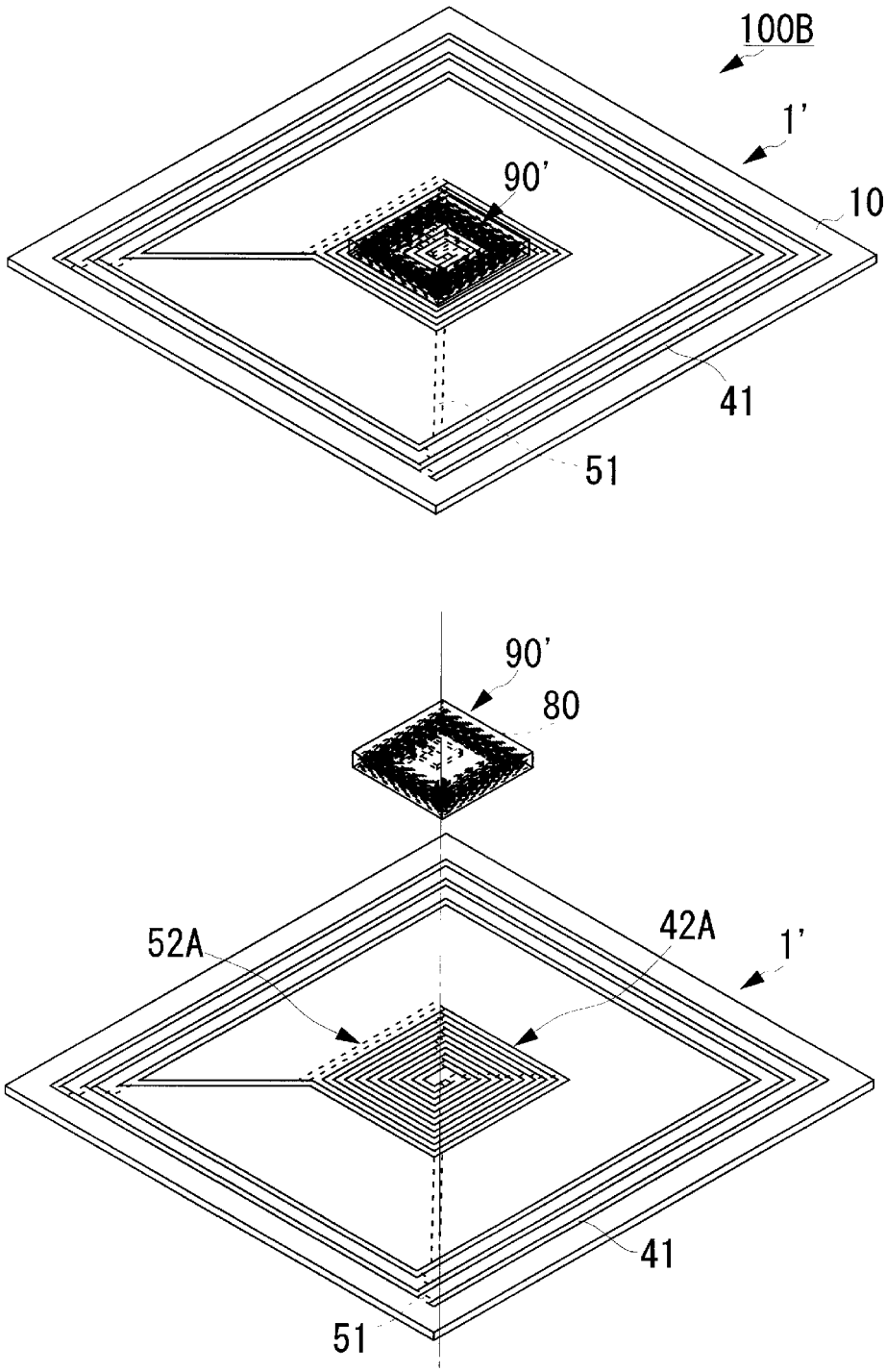
FIG. 10 includes a perspective view of an appearance and an exploded perspective view illustrating a configuration of an antenna module 100B according to a fifth preferred embodiment of the present invention.

FIG. 10A is a perspective view of an appearance illustrating a configuration of an antenna module 100B according to the fifth preferred embodiment, and FIG. 10B is an exploded perspective view thereof. Furthermore, FIG. 11A is a perspective view of an appearance illustrating a configuration of an electromagnetic coupling module 90 used in the present preferred embodiment, and FIG. 11B is an exploded lamination view thereof.

The antenna module 100B includes an antenna 1' and an electromagnetic coupling module 90'. The antenna 1' preferably is the same as that described in the second preferred embodiment.

Figure 11A:
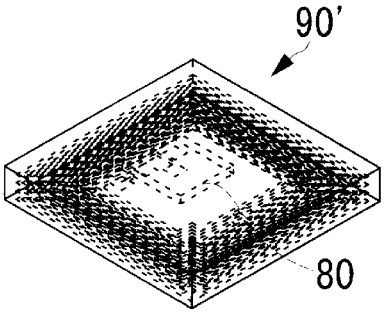
FIGS. 11A and 11B include a perspective view of an appearance and an exploded lamination view illustrating an electromagnetic coupling module 90' used in the antenna module 100B shown in FIG. 10.
Figure 11B:
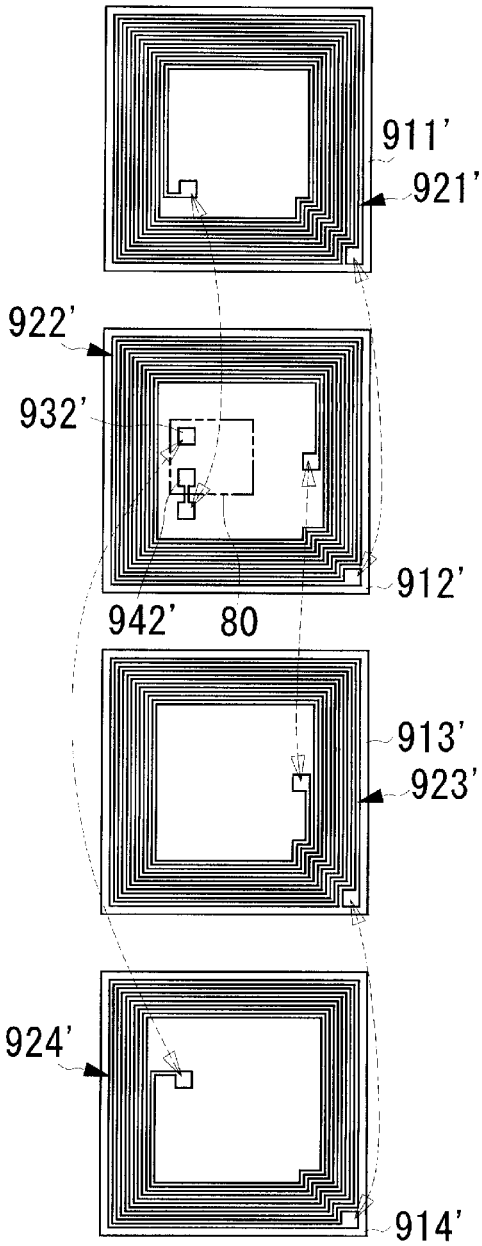

The electromagnetic coupling module 90' is configured, as shown in FIGS. 11A and 11B, such that a wireless communication IC 80 is disposed in a lamination circuit board including dielectric layers 911' to 914' laminated therein. The dielectric layers 911' to 914' include power-supply coil electrodes 921' to 924', respectively, each of which is defined by a group of wound electrodes. The power-supply coil electrodes 921' to 924' are electrically connected to one another through via holes so as to define a power-supply coil. Both ends of the power-supply coil are connected to mounting lands 932' and 942', respectively, located on the dielectric layer 912' through the via holes. The wireless communication IC 80 is packaged in the lamination circuit board in a state in which the wireless communication IC 80 is mounted on the mounting lands 932' and 942'.

The electromagnetic coupling module 90' having the configuration described above is disposed on first ends 42A and 52A of the antenna 1' and is fixed by an adhesive agent or the like, for example. With this configuration, the first ends 42A and 52A of the antenna 1' having winding shapes and the power-supply coil defined by the power-supply coil electrodes 921' to 924' of the electromagnetic coupling module 90' are electromagnetically coupled with one another so as to define the antenna module 100B.

Since the electromagnetic coupling module 90' is disposed on the first ends 42A and 52A of the antenna 1' having the winding shapes, the antenna 1' and the electromagnetic coupling module 90' are electromagnetically coupled with each other by a magnetic field enhanced by the first ends 42A and 52A, and accordingly, a high coupling degree is attained. Consequently, the antenna module having excellent communication performance can be attained.

Note that, in each of the antenna modules according to the fourth and fifth preferred embodiments, a communication band can be broadened by separating a resonant frequency of the electromagnetic coupling module and a resonant frequency of the antenna by a predetermined frequency. Specifically, the resonant frequency of the electromagnetic coupling module is preferably set to about 13.5 MHz which is the same as a frequency of a communication signal and the resonant frequency of the antenna is preferably set higher than about 13.5 MHz by a predetermined frequency (approximately 1 MHz, for example). By this, the resonant frequency of the electromagnetic coupling module and the resonant frequency of the antenna form two valley portions in a reflection characteristic. The reflection characteristic of a low reflection band is attained by these valley portions and surrounding bands, and accordingly, a passband can be broadened.

Furthermore, when a degree of coupling between the magnetic coupling module and the antenna is preferably set equal to or lower than about 0.5, a resonant point of the electromagnetic coupling module and a resonant point of the antenna are shifted from each other. Accordingly, a broadband is attained as a whole.

The electromagnetic coupling module is considerably small, and the resonant frequency thereof is negligibly changed by an external factor. Furthermore, the resonant frequency of the antenna is negligibly changed as described above by an external factor. Therefore, the reflection characteristic of the antenna module including the electromagnetic coupling module and the antenna is negligibly changed. Accordingly, an antenna module which is capable of performing communication with low loss and which is hardly affected by an external factor can be fabricated.

Next, an antenna module according to a sixth preferred embodiment will be described with reference to the accompanying drawings.

Figure 12A:
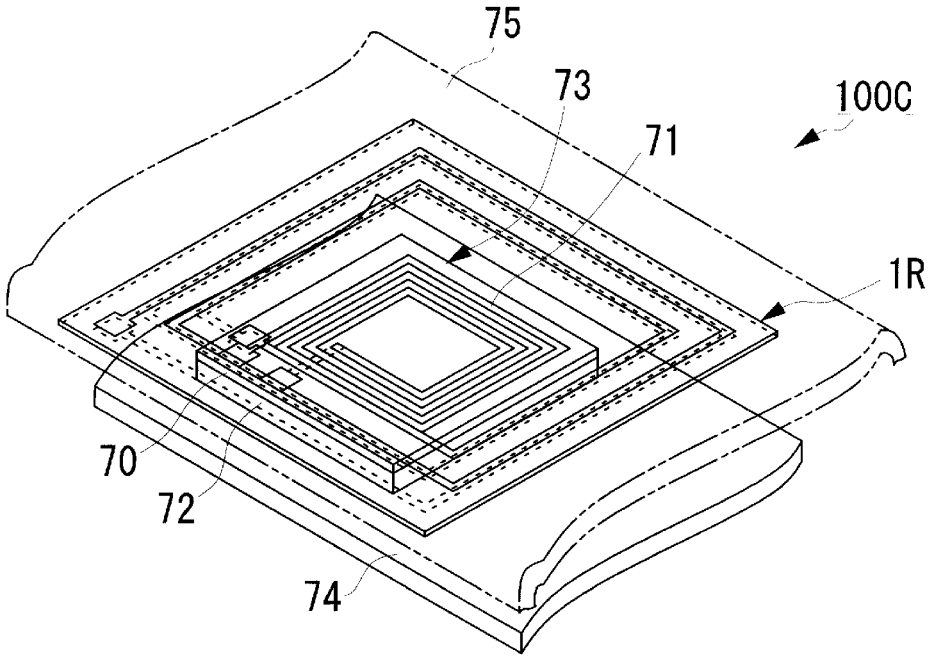
FIGS. 12A and 12B include an exploded perspective view and a side view illustrating a configuration of an antenna module 100C according to a sixth preferred embodiment of the present invention.
Figure 12B:
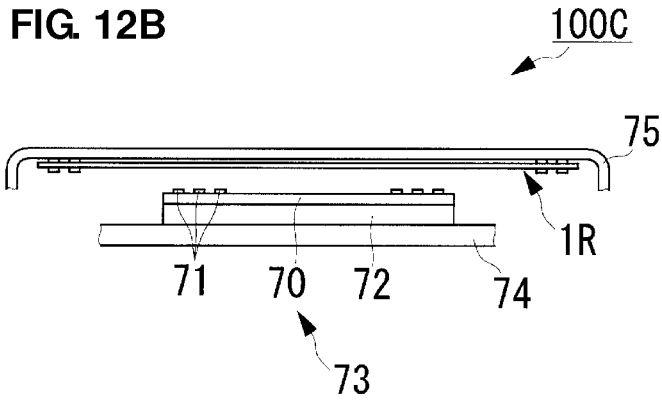

FIGS. 12A and 12B are an exploded perspective view and a side view, respectively, illustrating a configuration of an antenna module 100C according to the sixth preferred embodiment of the present invention.

The antenna module 100C of the present preferred embodiment of the present invention preferably is different from the antenna modules of the foregoing preferred embodiments in that an antenna 1 is not directly used for radiation but used to amplify a magnetic field radiated from another base antenna.

The antenna module 100C includes a base antenna 73 which performs magnetic-field radiation using a communication signal. The base antenna 73 includes a flexible sheet 70 and a base coil electrode 71 located on a first main surface of the flexible sheet 70. A magnetic sheet 72 is disposed on a second main surface of the flexible sheet 70 positioned opposite to the first main surface on which the base coil electrode 71 is disposed. The base antenna 73 is mounted through the magnetic sheet 72 on a base circuit board 74 of an electronic apparatus on which the antenna module 100C is mounted.

A resonant antenna 1R preferably has a configuration the same as that of the antenna 1 of the first preferred embodiment described above, and is disposed in a position far away from the surface on which the base coil electrode 71 is disposed by a predetermined distance. The resonant antenna 1R is attached and fixed to an inner surface of a housing 75 of the electronic apparatus as shown in FIG. 12, for example.

With this configuration, a resonant frequency of the resonant antenna 1R is set in accordance with a communication frequency of a communication signal as described in the first preferred embodiment and a magnetic field obtained in accordance with the communication signal is radiated from the base antenna 73. When the radiation is performed, the radiated magnetic field is amplified by the resonant antenna 1R and reaches an external region far from the housing 75 by a predetermined distance which is not reached only using the base antenna 73. As a result, when compared with a configuration in which only the base antenna 73 is included, a longer communication distance and a wider communication range is attained, and accordingly, a communication performance is improved.

Furthermore, also in a case where the antenna module having such a configuration is used, when a resonant frequency of the base antenna 73 and a resonant frequency of the resonant antenna 1R are appropriately set as described above, the antenna module which can be used in a broad communication band with a low loss and which is hardly affected by external factors can be fabricated.

Figure 13A:
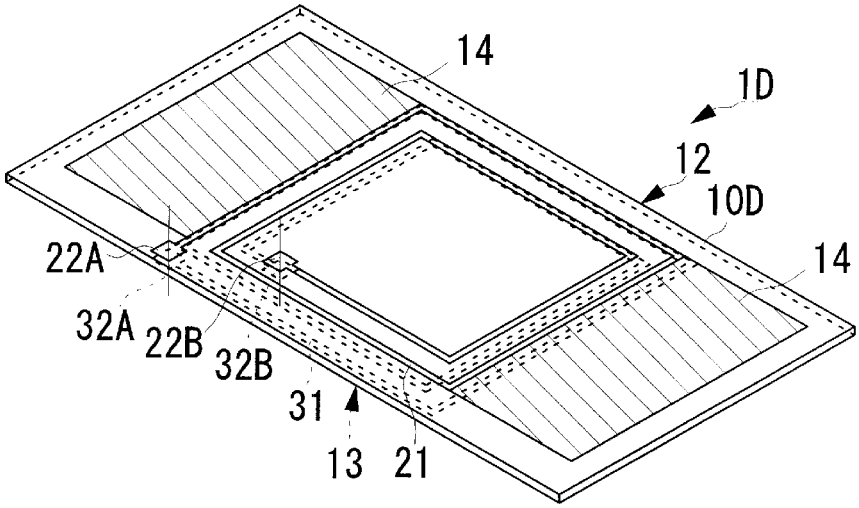
FIGS. 13A and 13B include a perspective view of an appearance and an exploded perspective view illustrating a configuration of an antenna 1D including flat electrodes 14.

Note that although each of the antennas of the foregoing preferred embodiments preferably includes the coil electrodes defined by the linear electrodes, each of the antennas may further includes flat electrodes as shown in FIGS. 13A to 15B. FIGS. 13A is a perspective view of an appearance illustrating a configuration of an antenna 1D including flat electrodes 14, and FIG. 13B is an exploded perspective view of the antenna 1D. Furthermore, FIG. 14A is a perspective view of an appearance illustrating a configuration of an antenna 1E including flat electrodes 14 having configurations different from those shown in FIGS. 13A and 13B. FIG. 14B is an exploded perspective view of the antenna 1E. FIG. 15A is a perspective view of an appearance illustrating a configuration of an antenna 1F including a flat electrode 14A having a configuration different from those shown in FIGS. 13A, 13B, 14A and 14B. FIG. 14B is a plan view of the antenna 1F.

Figure 13B:
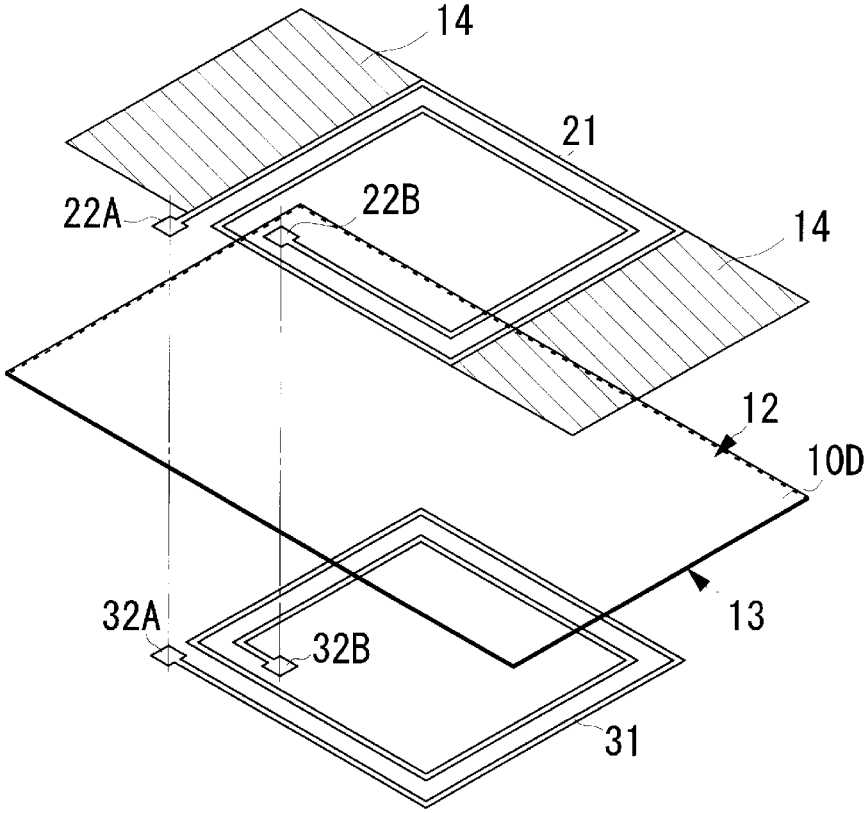

As shown in FIGS. 13A and 13B, in the antenna 1D, the flat electrodes 14 are located on a first main surface 12 of a flexible sheet 10D. The flat electrodes 14 are disposed so as to be adjacent to an outermost periphery of the first coil electrode 21. A first coil electrode 21 is disposed between the two flat electrodes 14 disposed on the first main surface 12. With this configuration, a magnetic flux generated by the first coil electrode 21 and a second coil electrode 31 widely circles in an external direction due to the flat electrodes 14. Accordingly, a longer communication distance and a wider communication range can be attained. In this configuration, by merely enlarging an area of the flexible sheet 10D and forming the flat electrodes 14, an antenna which has a simple configuration and which is easily fabricated attains improved communication performance.

Figure 14A:
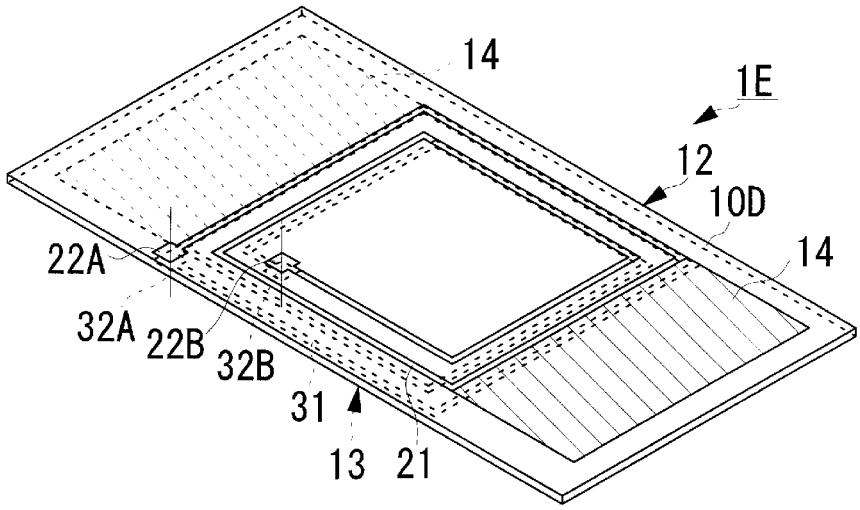
FIGS. 14A and 14B include a perspective view of an appearance and an exploded perspective view illustrating a configuration of another antenna 1E including flat electrodes 14.
Figure 14B:
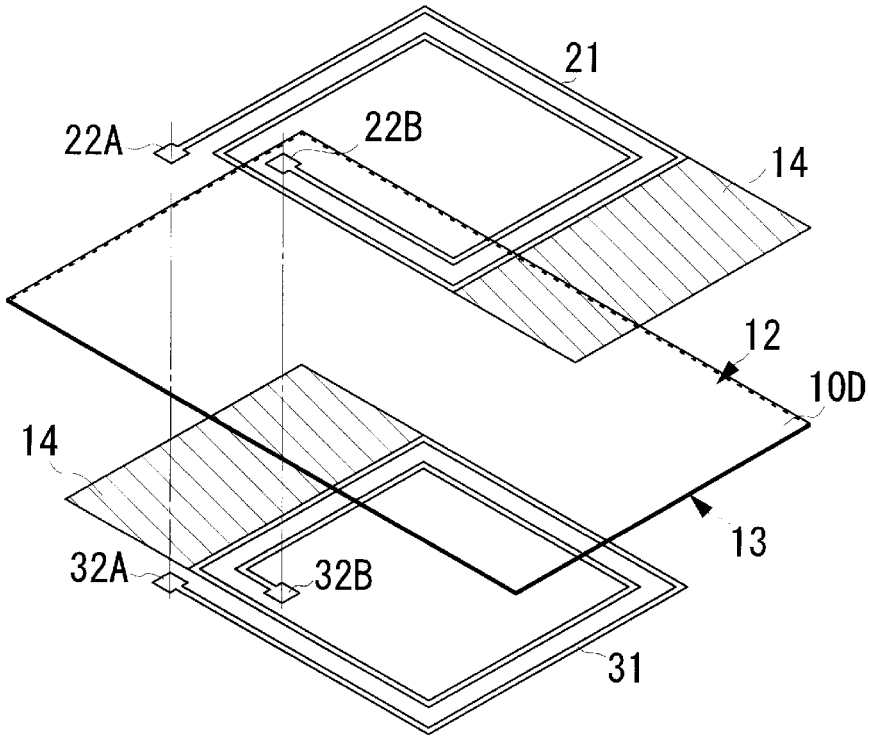

In the antenna 1E shown in FIGS. 14A and 14B, one of two flat electrodes 14 is disposed on a first main surface 12 (a surface nearer a first coil electrode 21) of a flexible sheet 10D and the other is disposed on a second main surface 13 (a surface nearer a second coil electrode 31) of the flexible sheet 10D. Here, the flat electrode 14 disposed on the first main surface 12 and the flat electrode 14 disposed on the second main surface 13 are opposed to each other with a formation region in which the first and second coil electrodes 21 and 31 are located interposed therebetween. Also with this configuration, as with the antenna 1D shown in FIGS. 13A and 13B, communication performance is significantly improved.

Figure 15A:
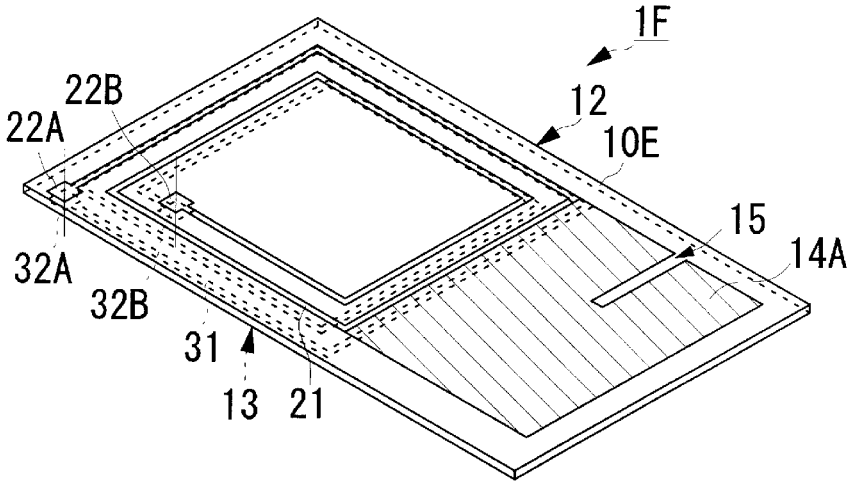
FIGS. 15A and 15B include a perspective view of an appearance and an exploded perspective view illustrating a configuration of still another antenna 1F including a flat electrode 14A.
Figure 15B:
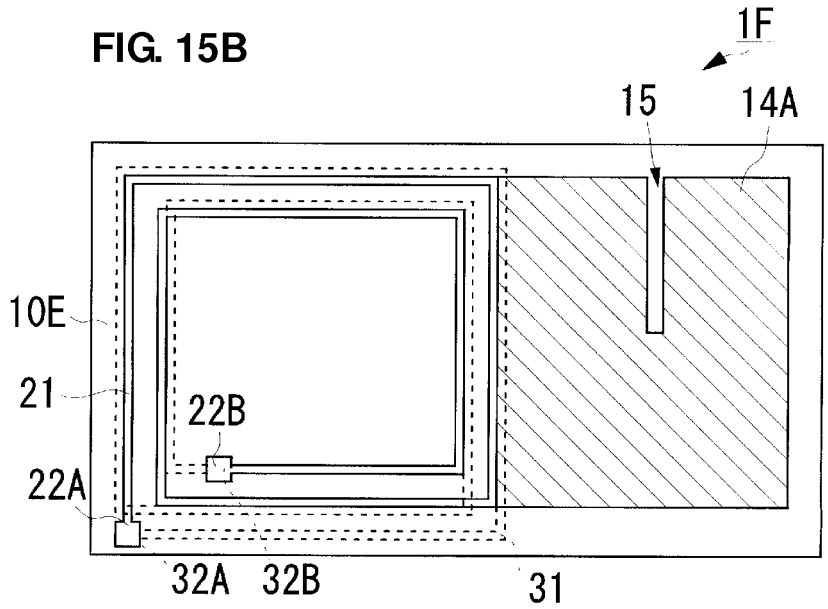

In the antenna 1F shown in FIGS. 15A and 15B, a flat electrode 14 is disposed only on a first main surface 12 of a flexible sheet 10. Also with this configuration, communication performance can be improved. Note that the flat electrode 14 may be similarly disposed only on a second main surface 13. Furthermore, in the antenna 1F shown in FIGS. 15A and 15B, a cutout portion 15 in which an electrode is cut out is formed on the flat electrode 14. In this case, the cutout portion 15 extends toward a center from a side of the flat electrode 14. With this configuration, eddy current is prevented from being generated in the flat electrode 14. In this way, an antenna having an excellent communication characteristic can be realized.

Note that each of the flat electrodes 14 and 14A may be arranged so as to be adjacent to the first coil electrode 21 or the second coil electrode 31 with a small gap interposed therebetween.

Figure 16:
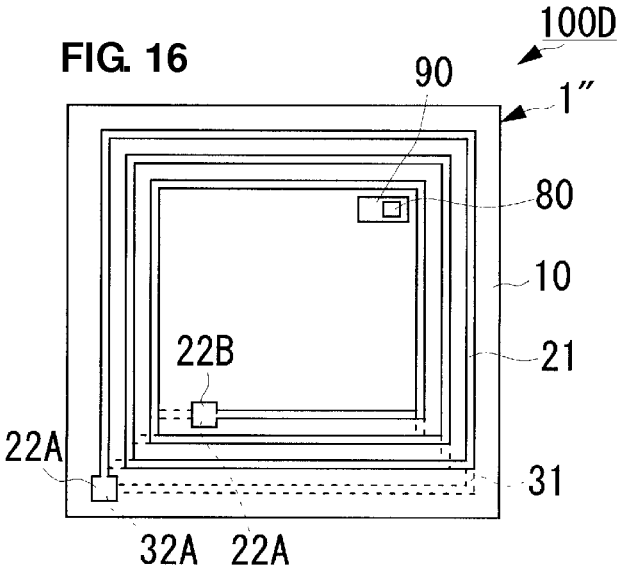
FIG. 16 is a plan view illustrating an antenna module 100D including an electromagnetic coupling module according to another arrangement example.

Furthermore, although the electromagnetic coupling module is disposed on the first coil electrode or near the first coil electrode in the foregoing description, the electromagnetic coupling module may be disposed in a predetermined position in a loop of the first coil electrode. FIG. 16 is a plan view illustrating an antenna module 100D including an electromagnetic coupling module arranged as another arrangement example. As shown in FIG. 16, the antenna module 100D includes an antenna 1" and an electromagnetic coupling module 90 described above. The electromagnetic coupling module 90 is disposed in a position included in an inner region of a loop of a first coil electrode 21 and near a corner portion corresponding to a bending portion of the first coil electrode 21. In this case, a long-side direction and a short-side direction of the electromagnetic coupling module 90 are parallel or substantially parallel to corresponding length directions of the first coil electrode 21 in the vicinity of the corner portion. With this configuration, a direction of a magnetic flux of the power supply coil electrode of the power supply substrate of the electromagnetic coupling module 0 coincides with a direction of a magnetic flux of the first coil electrode 21. Accordingly, coupling between the electromagnetic coupling module 90 and the antenna 1" can be enhanced.

Furthermore, although the wireless communication IC is preferably mounted on the surface of the power supply substrate in the electromagnetic coupling modules according to the foregoing preferred embodiments, the wireless communication IC may be incorporated in the power supply substrate.

Figure 17:
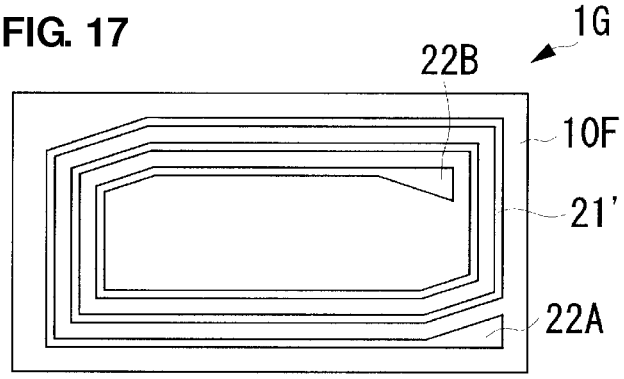
FIG. 17 is a plan view illustrating a configuration of an antenna 1G viewed from a first main surface 12 side.

Moreover, in the foregoing preferred embodiments, the coil electrodes are preferably arranged such that appearances of the coil electrodes have substantially square shapes in a plan view, for example. However, as shown in FIG. 17, a coil electrode may be wound so as to have a rectangular shape, for example. FIG. 17 is a plan view illustrating a configuration of an antenna 1G viewed from a first main surface 12 side. Note that, although only the first main surface 12 side is shown in FIG. 17, a second main surface 13 side is configured so as to cooperate with a first coil electrode 21' located on the first main surface 12 similarly to the foregoing preferred embodiments.

The antenna 1G shown in FIG. 17 includes a flexible sheet 10F having a rectangular shape in a plan view. The first coil electrode 21' is wound so that an appearance thereof has a rectangular shape in a plan view. The first coil electrode 21' includes a first end 22A in an outermost periphery and a second end 22B in an innermost periphery. The first and second ends 22A and 22B have widths larger than an electrode width of a winding portion of the first coil electrode 21'.

Furthermore, some corner portions of the winding portion of the first coil electrode 21' do not have a right angle and include a plurality of bent portions having blunt angles. That is, the first coil electrode 21' is formed such that some of the corner portions are chamfered in a plan view. Note that, in FIG. 17, each of two corner portions diagonally arranged includes a plurality of bent portions. However, at least one of the corner portions should have such a shape. With this configuration, even when a zone in which a magnetic field caused by an external reader/writer is generated is biased, the biased magnetic field can be easily received.

Furthermore, in the foregoing preferred embodiments, areas of ends of the first coil electrode are substantially equal to those of the second coil electrode. However, one of the end electrodes which face each other may have an area larger than the other. With this configuration, in a case where the first and second coil electrodes are located on respective surfaces of the sheet, even when a position shift is generated, a predetermined facing area can be easily ensured. Accordingly, a change in a capacitance is prevented from occurring.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna module comprising:

an antenna including:

an insulation base member including first and second main surfaces which face each other;

a first coil electrode arranged on the first main surface in a winding manner and including end portions; and a second coil electrode arranged on the second main surface, wound in a direction opposite to a winding direction of the first coil electrode when viewed in a direction from the second main surface to the first main surface, and including end portions; and an electromagnetic coupling module including a wireless communication IC and a power-supply coil connected to the wireless communication IC; wherein in a planar view, the electromagnetic coupling module is arranged on the first main surface of the insulation base member so that the electromagnetic coupling module overlaps only with an electrode included in a group of electrodes that are arranged in parallel or substantially in parallel and are defined by the first coil electrode; and the power-supply coil is electromagnetically coupled with the first coil electrode.

2. The antenna module according to claim 1, wherein at least one of the end portions of the first coil electrode and at least one of the end portions of the second coil electrode include flat electrodes having electrode widths larger than that of the first coil electrode and that of the second coil electrode, respectively.

3. The antenna module according to claim 2, wherein both of the end portions of the first coil electrode and both of the end portions of the second coil electrode include flat electrodes having electrode widths larger than that of the first coil electrode and that of the second coil electrode, respectively, and one of the end portions of the first coil electrode faces one of the end portions of the second coil electrode and the other of the end portions of the first coil electrode faces the other of the end portions of the second coil electrode.

4. The antenna module according to claim 1, wherein one of the end portions of the first coil electrode and one of the end portions of the second coil electrode have winding shapes, and the end portion having the winding shape of the first coil electrode faces the end portion having the winding shape of the second coil electrode.

5. The antenna module according to claim 4, wherein the end portions having the winding shapes are positioned substantially in centers of regions defined in the first and second coil electrodes.

6. The antenna module according to claim 1, further comprising at least one of a flat electrode located on the first main surface so as to be adjacent to the first coil electrode and a flat electrode located on the second main surface so as to be adjacent to the second coil electrode.

7. The antenna module according to claim 1, further comprising:

the wireless communication IC electrically connected to the second coil electrode.

8. The antenna module according to claim 1, wherein the wireless communication IC is connected to a center electrode included in the group of electrodes.

9. The antenna module according to claim 1, wherein the electromagnetic coupling module includes an inductor that is electromagnetically coupled with the first coil electrode or the second coil electrode.

10. The antenna module according to claim 9, wherein the electromagnetic coupling module is disposed on the first coil electrode or the second coil electrode.

11. The antenna module according to claim 9, wherein the electromagnetic coupling module is disposed on a center electrode included in the group of electrodes.

12. The antenna module according to claim 9, wherein the electromagnetic coupling module is disposed such that the electromagnetic coupling module is electromagnetically coupled with only one of the electrodes included in the first coil electrode or the second coil electrode.

13. The antenna module according to claim 4, wherein the electromagnetic coupling module includes an inductor and is disposed in a position which substantially corresponds to the end portion having the winding shape when the first main surface of the insulation base member is viewed in a planar manner.

14. The antenna module according to claim 1, further comprising:

a base antenna arranged to generate a magnetic field in accordance with communication data supplied to the wireless communication IC; wherein the antenna is disposed separately from the base antenna with a predetermined gap interposed therebetween.

15. An antenna module comprising:

an antenna including:

an insulation base member including first and second main surfaces which face each other;

a first coil electrode arranged on the first main surface in a winding manner; and a second coil electrode arranged on the second main surface, wound in a direction opposite to a winding direction of the first coil electrode when viewed in a direction from the second main surface to the first main surface; and an electromagnetic coupling module including a wireless communication IC and a power-supply coil connected to the wireless communication IC; wherein in a planar view, the electromagnetic coupling module is disposed on the first main surface of the insulation base member so that the electromagnetic coupling module is disposed on an inner side relative to an innermost electrode and adjacent to the innermost electrode;

the innermost electrode is included in a group of electrodes that are arranged in parallel or substantially in parallel and are defined by the first coil electrode; and the power-supply coil is electromagnetically coupled with the first coil electrode.

* * * * *